US012129092B2

(12) United States Patent
Dan et al.

(10) Patent No.: US 12,129,092 B2
(45) Date of Patent: Oct. 29, 2024

(54) POUCH-CONTAINER PACKAGING MATERIAL, AND POUCH-CONTAINER PACKAGING BODY

(71) Applicant: FUJI SEAL INTERNATIONAL, INC., Osaka (JP)

(72) Inventors: Yuma Dan, Osaka (JP); Tadashi Takano, Osaka (JP)

(73) Assignee: FUJI SEAL INTERNATIONAL, INC., Osaka (JP)

( * ) Notice: Subject to any disclaimer, the term of this patent is extended or adjusted under 35 U.S.C. 154(b) by 267 days.

(21) Appl. No.: 17/784,311

(22) PCT Filed: Dec. 10, 2020

(86) PCT No.: PCT/JP2020/045980
§ 371 (c)(1),
(2) Date: Jun. 10, 2022

(87) PCT Pub. No.: WO2021/125026
PCT Pub. Date: Jun. 24, 2021

(65) Prior Publication Data

US 2023/0046638 A1 Feb. 16, 2023

(30) Foreign Application Priority Data

Dec. 19, 2019 (JP) ..... 2019-229270

(51) Int. Cl.
*B65D 75/28* (2006.01)
*B65D 33/25* (2006.01)
*B65D 75/58* (2006.01)

(52) U.S. Cl.
CPC ..... *B65D 75/28* (2013.01); *B65D 33/2508* (2013.01); *B65D 75/5883* (2013.01); *B65D 2575/586* (2013.01)

(58) Field of Classification Search
CPC ..... B65D 75/5883
(Continued)

(56) References Cited

U.S. PATENT DOCUMENTS 411,954 A * 10/1889 Eggers ..... B65D 33/10 383/41
1,236,159 A * 8/1917 Gatlin ..... B65D 31/02 383/905

(Continued)

FOREIGN PATENT DOCUMENTS

EP 677832 A1 * 10/1995 ..... B65D 33/18
EP 1010632 A1 * 6/2000 ..... B65D 33/18

(Continued)

OTHER PUBLICATIONS

Jan. 15, 2024 Extended European Search Report issued in European Patent Application No. 20904134.2.

(Continued)

*Primary Examiner* — Paul R Durand
*Assistant Examiner* — Michael J. Melaragno
(74) *Attorney, Agent, or Firm* — Oliff PLC

(57) ABSTRACT

A pouch-type container including a pair of main-body sheets defining a storage space for containing a packaged substance; an opening at a first end of the main-body sheets in a z-direction; a spout at a second end, opposite the opening, of the main-body sheets in the z-direction; and an opening/closing part offset from the opening toward the second end in the z-direction to open and close the storage space. The pouch-type container further includes: a locking band fixed to the main-body sheets at a pair of fixed portions spaced apart in a width direction (x direction) to define an insertion space with the outer surface of one of the main-body sheets, the width direction being perpendicular to the y-direction wherein the main-body sheets face each other and the (Continued)

z-direction; and a lock part including at least one of the main-body sheets and configured to be locked with the locking band.

8 Claims, 19 Drawing Sheets

(58) Field of Classification Search
USPC ..... 383/61.3, 89, 61.2, 41, 63, 906
See application file for complete search history.

(56) References Cited

U.S. PATENT DOCUMENTS 1,782,240 A * 11/1930 Litchfield ..... B65D 33/26 383/89
1,919,819 A * 7/1933 Williams ..... B65D 33/30 383/905
2,138,066 A * 11/1938 Matchett ..... B65D 33/30 383/905
2,246,596 A * 6/1941 Moore ..... B65D 33/30 383/89
2,273,128 A * 2/1942 Madsen ..... A61F 7/08 383/61.3
2,342,406 A * 2/1944 Randall ..... A47G 25/54 493/215
2,345,434 A * 3/1944 Sterling ..... B65D 33/26 383/92
2,688,435 A * 9/1954 Vogt ..... B31F 1/205 383/88
3,203,551 A * 8/1965 Loan, Jr. ..... B01D 29/27 55/369
3,224,640 A * 12/1965 Schneider ..... B65D 31/12 383/88
3,254,829 A * 6/1966 Cooper ..... B65D 77/12 383/88
3,446,420 A * 5/1969 Rinecker ..... A44B 18/00 229/80
3,545,668 A * 12/1970 Hultberg ..... B65D 33/30 383/905
4,356,954 A * 11/1982 Mojonnier ..... B65D 33/30 383/905
4,637,063 A * 1/1987 Sullivan ..... B65D 33/25 383/61.3
4,638,912 A * 1/1987 Graf ..... B65D 33/16 383/203
4,706,297 A * 11/1987 Ausnit ..... B65D 33/2508 383/122
4,869,725 A * 9/1989 Schneider ..... A61J 1/10 383/33
4,876,125 A * 10/1989 Akao ..... B65D 31/02 383/88
4,911,563 A * 3/1990 Ciani ..... B65D 33/1691 383/89
5,007,233 A * 4/1991 Bose ..... B65B 51/225 383/89
5,048,692 A * 9/1991 Handler ..... B65D 33/2533 383/203
5,226,564 A * 7/1993 Steer ..... B29C 65/64 383/906
5,334,180 A * 8/1994 Adolf ..... B29C 66/306 604/905
5,417,495 A * 5/1995 Branson ..... B65D 33/2508 383/5
5,582,889 A * 12/1996 Pedrini ..... G09F 3/10 383/62
5,709,467 A * 1/1998 Galliano, II ..... A61C 9/0026 366/50
5,816,709 A * 10/1998 Demus ..... A45C 11/22 383/88
5,824,380 A * 10/1998 Hagen ..... B32B 7/12 383/62
5,941,640 A * 8/1999 Thatcher ..... A45F 3/04 383/30
6,053,635 A * 4/2000 Anderson ..... B65D 33/08 383/906
6,176,394 B1 * 1/2001 Shimko ..... B65D 75/5883 383/41
6,267,506 B1 * 7/2001 Campion ..... A45C 11/22 383/89
6,644,854 B2 * 11/2003 Lien ..... A45F 3/20 383/89
7,806,300 B1 * 10/2010 Noell ..... A45F 3/20 224/148.2
7,819,583 B2 * 10/2010 Walker ..... B65D 33/2508 383/205
7,879,015 B2 * 2/2011 Villefrance ..... A61F 5/4405 604/338
7,879,016 B2 * 2/2011 Mandzij ..... A61F 5/4407 4/144.1
8,007,174 B2 * 8/2011 Yamaguchi ..... B65D 75/5805 383/41
8,672,907 B2 * 3/2014 Friske ..... A61F 5/4407 604/335
8,821,463 B2 * 9/2014 Grum-Schwensen ..... A61F 5/443 604/332
8,888,760 B2 * 11/2014 Andersen ..... A61F 5/44 604/335
9,668,910 B2 * 6/2017 Murray ..... A61F 5/4407
9,949,864 B2 * 4/2018 Ben-Arie ..... A61F 5/4407
9,956,110 B2 * 5/2018 Ben-Arie ..... A61F 5/445
10,849,412 B2 * 12/2020 Heward ..... A45F 3/20
11,826,276 B2 * 11/2023 Weinberg ..... A61F 5/445
2003/0138170 A1 * 7/2003 Breil, Jr. ..... B65D 33/2533 383/86
2003/0194156 A1 * 10/2003 Lien ..... A45F 3/20 383/89
2004/0223665 A1 * 11/2004 Blohowiak ..... B65D 33/24 383/89
2006/0030471 A1 * 2/2006 Schaller ..... B65D 33/2533 493/213
2007/0104397 A1 * 5/2007 Walker ..... B65D 33/2508 383/61.3
2008/0124006 A1 * 5/2008 Yamaguchi ..... A61J 1/10 383/66
2009/0308023 A1 * 12/2009 Wada ..... B65D 75/5883 29/432
2011/0017812 A1 * 1/2011 Belko ..... B65D 33/2508 229/117.34
2011/0116730 A1 * 5/2011 Kawakami ..... B65D 75/566 383/41
2014/0053945 A1 * 2/2014 Albritton ..... B65D 75/5866 141/1
2014/0081203 A1 * 3/2014 Morimoto ..... A61J 7/0053 604/82
2015/0183555 A1 * 7/2015 Mitsui ..... B32B 27/34 383/10
2016/0304261 A1 * 10/2016 Takano ..... B65D 75/566
2017/0197771 A1 * 7/2017 Smith ..... B65D 75/5883
2017/0217641 A1 * 8/2017 Genaw, Jr. ..... B65D 33/2566
2018/0257834 A1 * 9/2018 Kaminaga ..... B32B 15/20
2018/0345171 A1 * 12/2018 Hampton ..... B65D 33/2508
2019/0144166 A1 * 5/2019 Amigoni ..... B65D 31/10 383/89
2019/0241339 A1 * 8/2019 Sako ..... B65D 75/00
2023/0046638 A1 * 2/2023 Dan ..... B65D 33/2508

FOREIGN PATENT DOCUMENTS

EP 4079656 A1 * 10/2022 ..... B65D 33/24
JP 3294043 B2 6/2002
JP 2005-206162 A 8/2005
JP 2008-127021 A 6/2008
JP 2010-111393 A 5/2010
JP 2021046252 A * 3/2021
WO WO-2021125026 A1 * 6/2021 ..... B65D 33/24

(56) References Cited

FOREIGN PATENT DOCUMENTS

OTHER PUBLICATIONS

Feb. 16, 2021 International Search Report issued in International Patent Application No. PCT/JP2020/045980.

* cited by examiner

POUCH-CONTAINER PACKAGING MATERIAL, AND POUCH-CONTAINER PACKAGING BODY

TECHNICAL FIELD

The present invention generally relates to a pouch-container packaging material, and also to a pouch-container packaging body.

BACKGROUND ART

Pouch-type containers are widely used as a container for e.g. food and toiletry products as well as enteral or intravenous nutrients and infusions because of their excellent sealing performance and ease in handling. Percutaneous Endoscopic Gastrostomy (hereinafter referred to as "PEG") is a known technique for providing nutrients to patients. By using PEG, nutrients can be provided to a patient through pressurization of a pouch package containing the nutrients. An example of such a pouch package for pressurization is disclosed in Patent Document 1. The pouch package disclosed in the document includes a pair of main-body sheets defining a storage space, a zip for closing the storage space, nutrients as the packaged substance contained in the storage space, and a spout for discharging the nutrients from the storage space. The patent document proposes using the pouch package with the main-body sheets folded back during pressurization.

TECHNICAL REFERENCE

Patent Document

Patent Document 1: JP-A-2008-127021

SUMMARY OF THE INVENTION

Problems to be Solved by the Invention

During pressurization of a pouch package, a pressure strong enough to discharge the nutrients through the spout is applied. If the pouch package is not in a proper condition, the nutrients can leak through the zip due to the pressure applied. In recent years, providing nutrients using PEG is often performed to a large number of patients in e.g. a large hospital. In such a case, leakage may more likely to occur due to insufficient folding or insufficient sealing with a zip, for example.

The present invention has been proposed under the above circumstances, and aims to provide a pouch-type container and a pouch package that allow the packaged substance to be discharged reliably through pressurization.

Means for Solving the Problems

According to a first aspect of the present invention, there is provided a pouch-type container including: a pair of main-body sheets defining a storage space for containing a packaged substance; an opening at a first end of the main-body sheets in a first direction; a spout at a second end, opposite the opening, of the main-body sheets in the first direction; and an opening/closing part offset from the opening toward the second end in the first direction and configured to open and close the storage space. The pouch-type container further includes: a locking band fixed to the main-body sheets at a pair of fixed portions spaced apart from each other in a width direction to define an insertion space with an outer surface of the main-body sheets, the width direction being perpendicular to a direction in which the main-body sheets face each other and the first direction; and a lock part comprising at least one of the main-body sheets and configured to be locked with the locking band by being inserted into the insertion space with the main-body sheets folded back.

In a preferred embodiment of the present invention, the lock part includes a constricted portion whose minimum dimension in the width direction is smaller than a dimension between the fixed portions in the width direction, and a wider portion offset from the constricted portion toward the first end in the first direction and having a dimension in the width direction larger than the dimension between the fixed portions in the width direction.

In a preferred embodiment of the present invention, the opening/closing part and the constricted portion overlap with each other in the first direction.

In a preferred embodiment of the present invention, the constricted portion has a base edge positioned inward in the width direction, a first edge offset from the base edge toward the first end in the first direction, and a second edge offset from the base edge toward the second end in the first direction. The first edge has an inclination angle with respect to the first direction that is larger than an inclination angle of the second edge with respect to the first direction.

In a preferred embodiment of the present invention, the fixed portions are provided on opposite sides of the storage space in the width direction.

In a preferred embodiment of the present invention, the opening/closing part is made of a first zip sheet and a second zip sheet that are joined to inner surfaces of the paired main-body sheets, respectively. Each of the first zip sheet and the second zip sheet has a zip part to perform an open/close function. The first zip sheet and the inner surface of one of the main-body sheets are joined only at a region offset from the zip part of the first zip sheet toward the first end in the first direction. The second zip sheet is joined to the inner surface of another one of the main-body sheets at least at opposite sides of the zip part of the second zip sheet in the first direction.

According to a second aspect of the present invention, there is provided a pouch package including the pouch-type container provided according to the first aspect of the present invention, and a packaged substance contained in the storage space.

Advantages of the Invention

According to the present invention, discharging the packaged substance through pressurization can be performed more reliably.

Other features and advantages of the present invention will become apparent from the detailed description given below with reference to the accompanying drawings.

MODE FOR CARRYING OUT THE INVENTION

Figure 1:
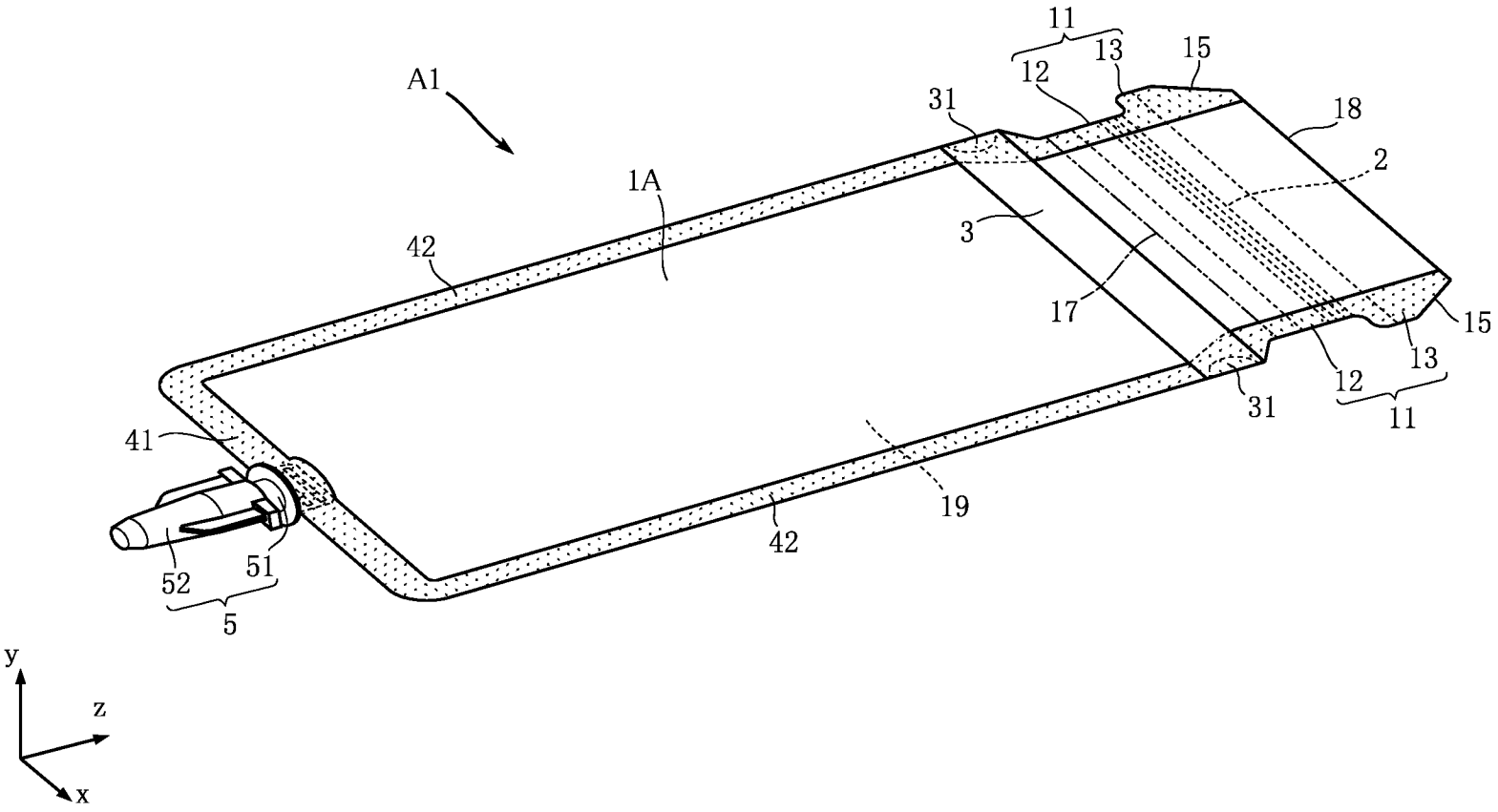
FIG. 1 is a perspective view of a pouch-type container according to a first embodiment of the present invention.

Preferred embodiments of the present invention are described below with reference to the drawings.

The terms "first", "second", "third", etc. are used herein merely as labels and are not intended to impose ordinal requirements on the items to which these terms refer.

First Embodiment

FIGS. 1 to 15 show a pouch-type container and a pouch package according to a first embodiment of the present invention. The pouch-type container A1 according to the present embodiment includes a pair of main-body sheets 1A and 1B, a lock part 11, an opening/closing part 2, a locking band 3, a bottom sealed part 41, a pair of side sealed parts 42, and a spout 5. The pouch package B1 is a package containing a substance 6 to be packaged in the pouch-type container A1. The uses of the pouch-type container A1 and the pouch package B1 are not limited in any way. In the description below, the use to provide nutrients to a patient by PEG is explained as an example.

Figure 2:
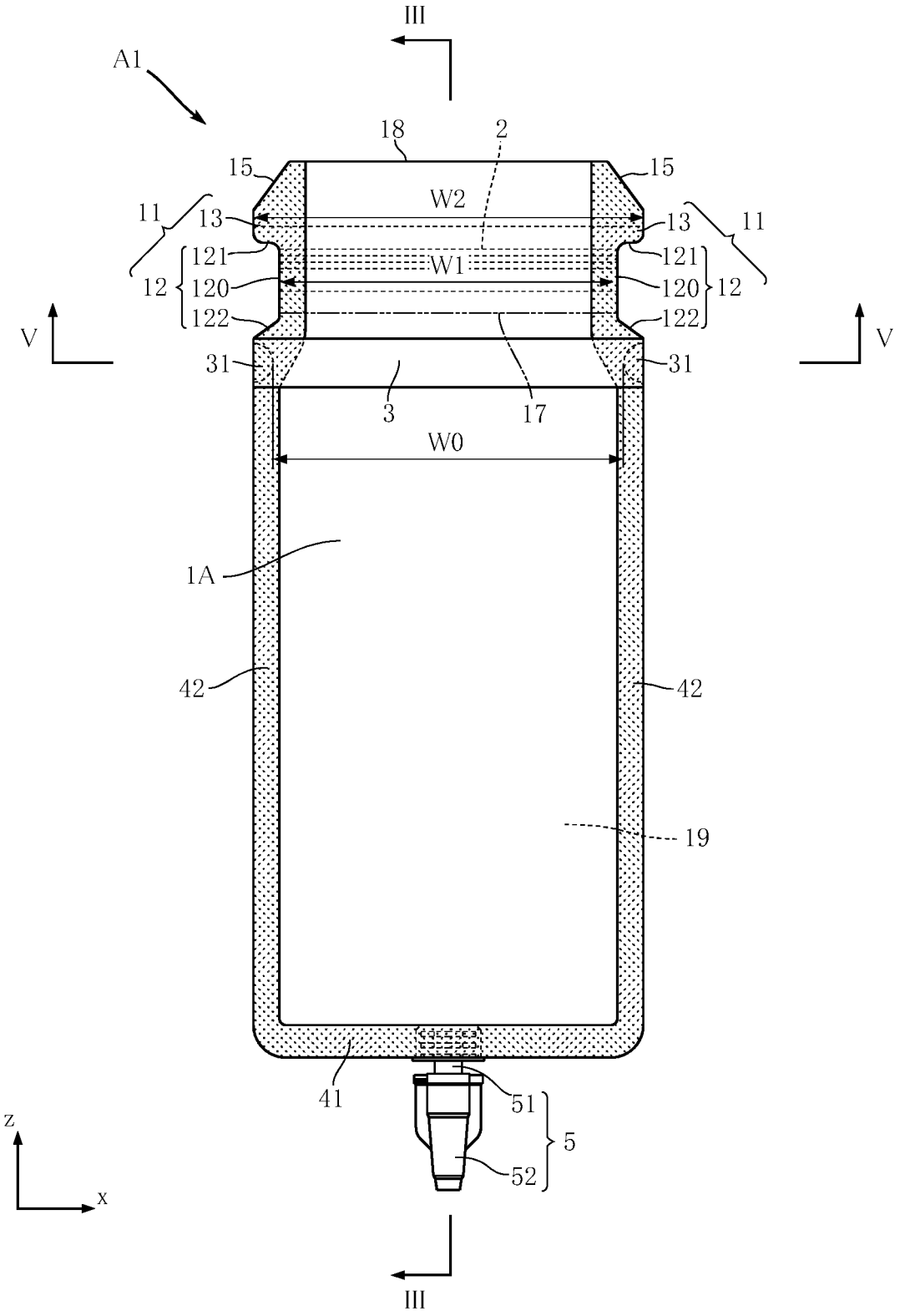
FIG. 2 is a front view of the pouch-type container according to the first embodiment of the present invention.
Figure 3:
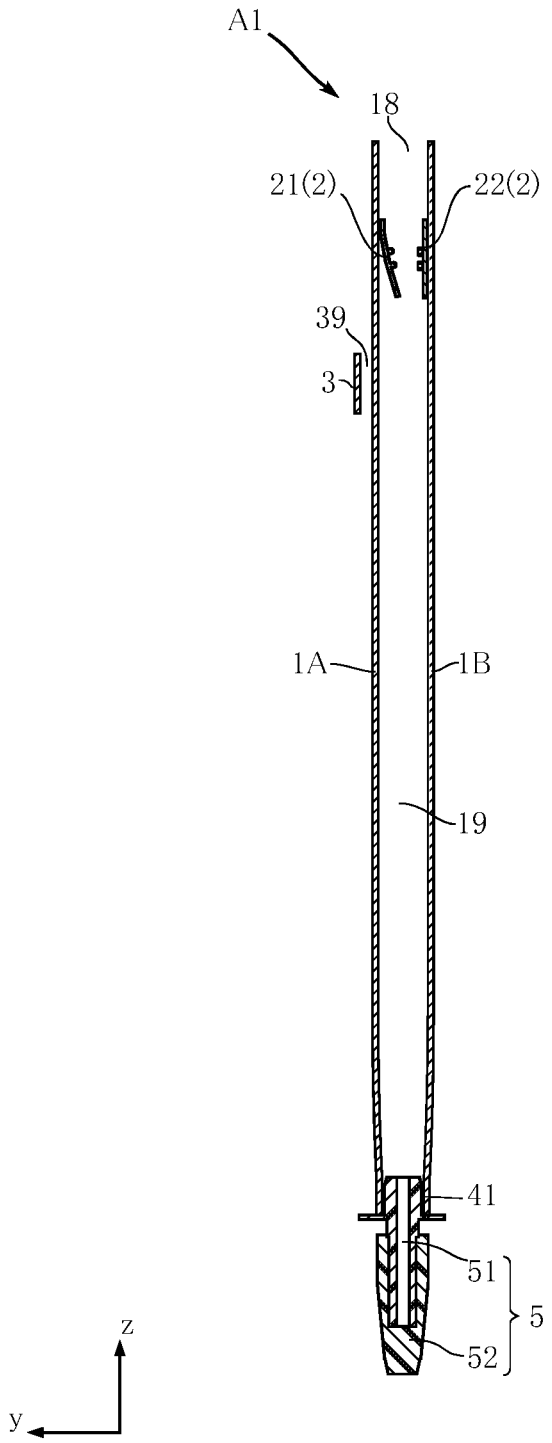
FIG. 3 is a sectional view taken along line III-III in FIG. 2.
Figure 4:
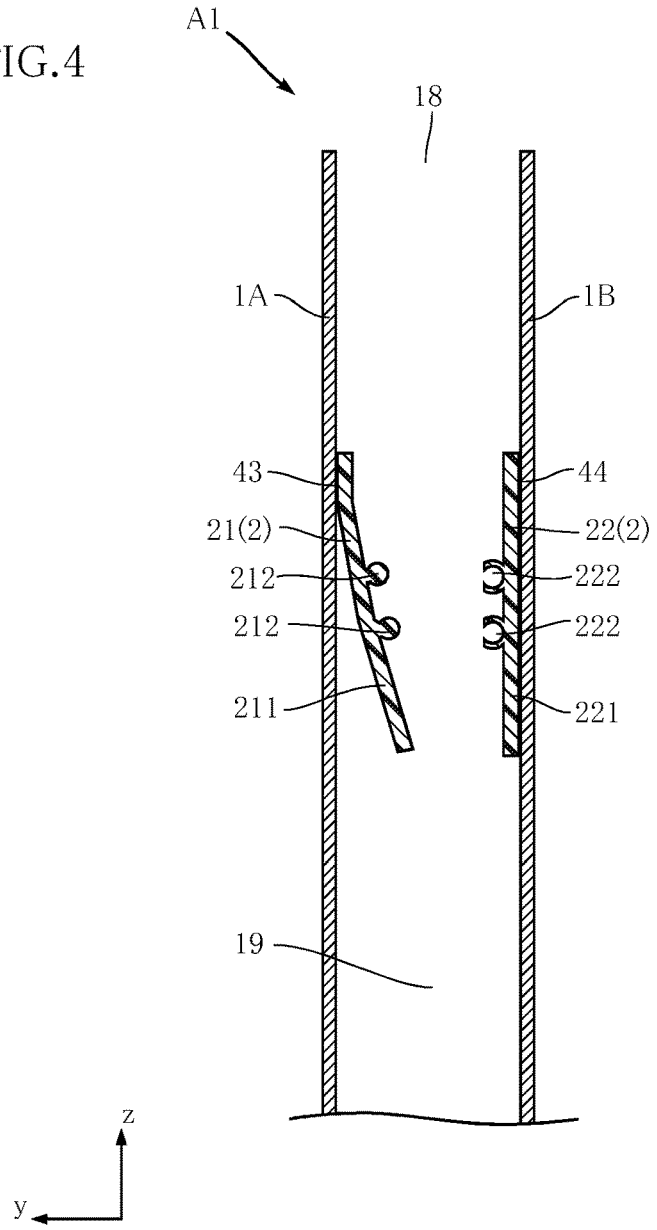
FIG. 4 is an enlarged sectional view showing a part of the pouch-type container according to the first embodiment of the present invention.
Figure 5:
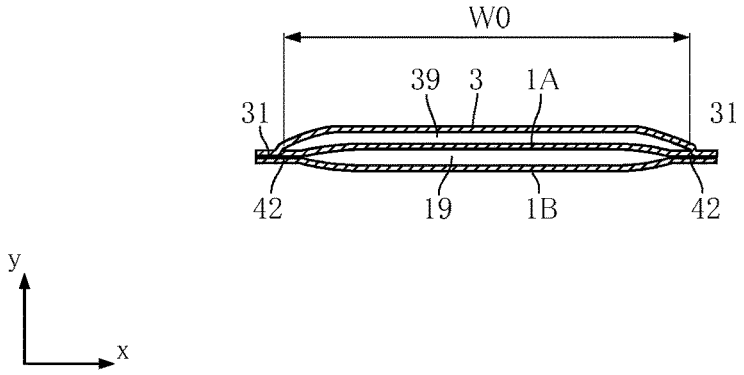
FIG. 5 is a sectional view taken along line V-V in FIG. 2.
Figure 6:
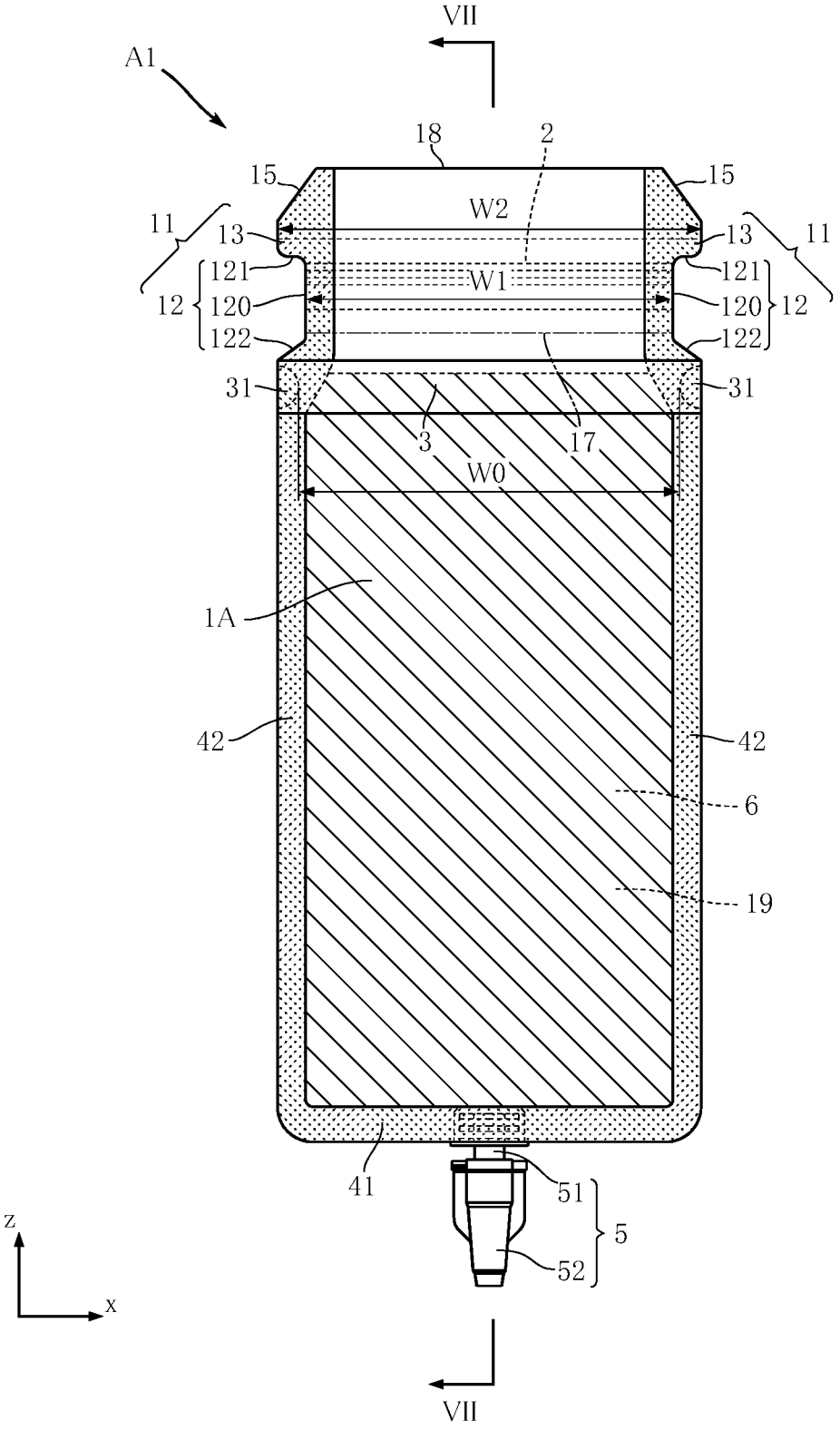
FIG. 6 is a front view of the pouch-type container in use according to the first embodiment of the present invention.
Figure 7:
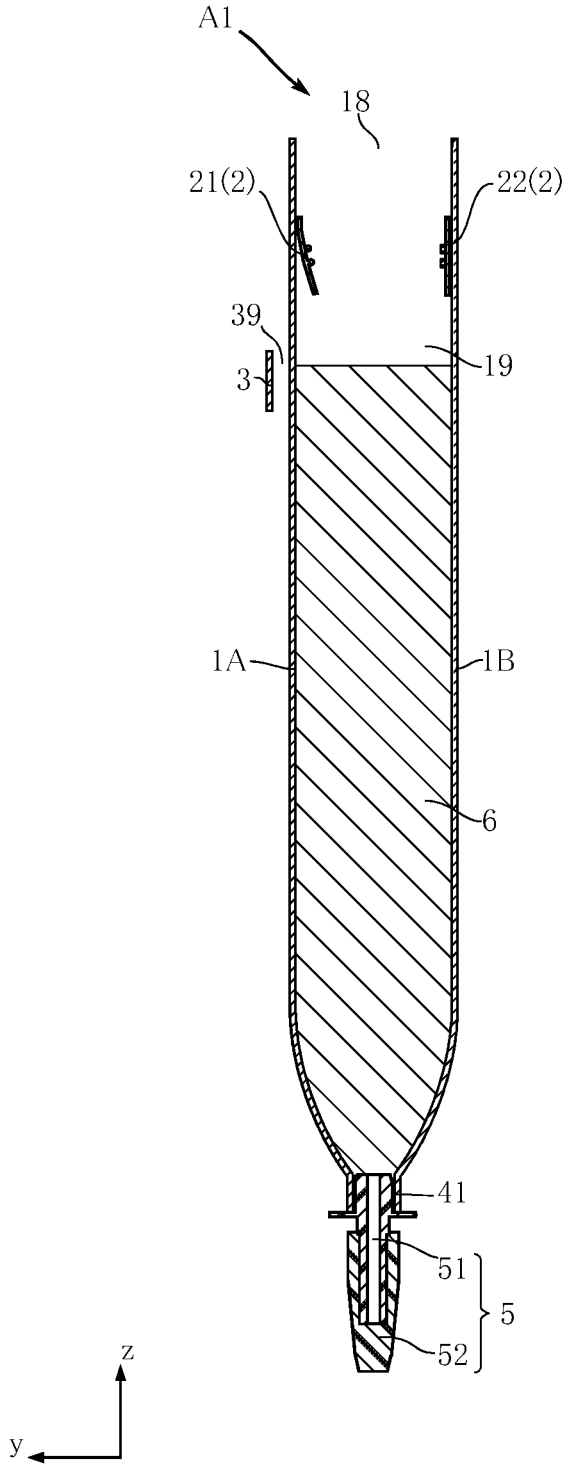
FIG. 7 is a sectional view taken along line VII-VII in FIG. 6.
Figure 8:
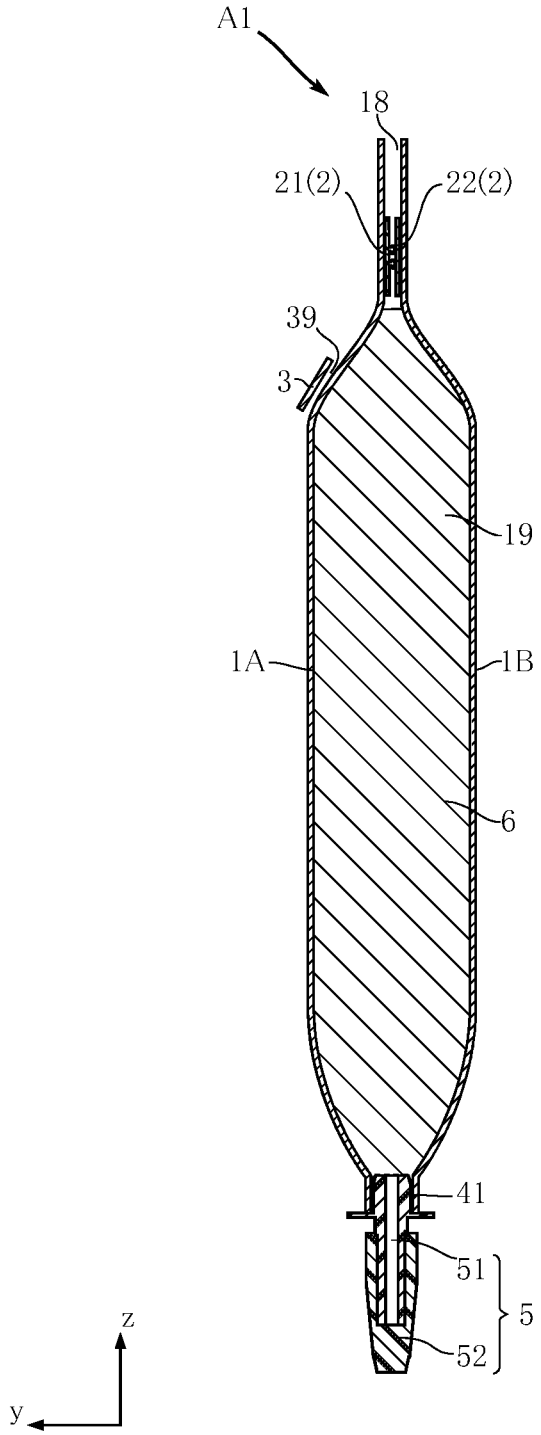
FIG. 8 is a sectional view showing the pouch-type container in use according to the first embodiment of the present invention.
Figure 9:
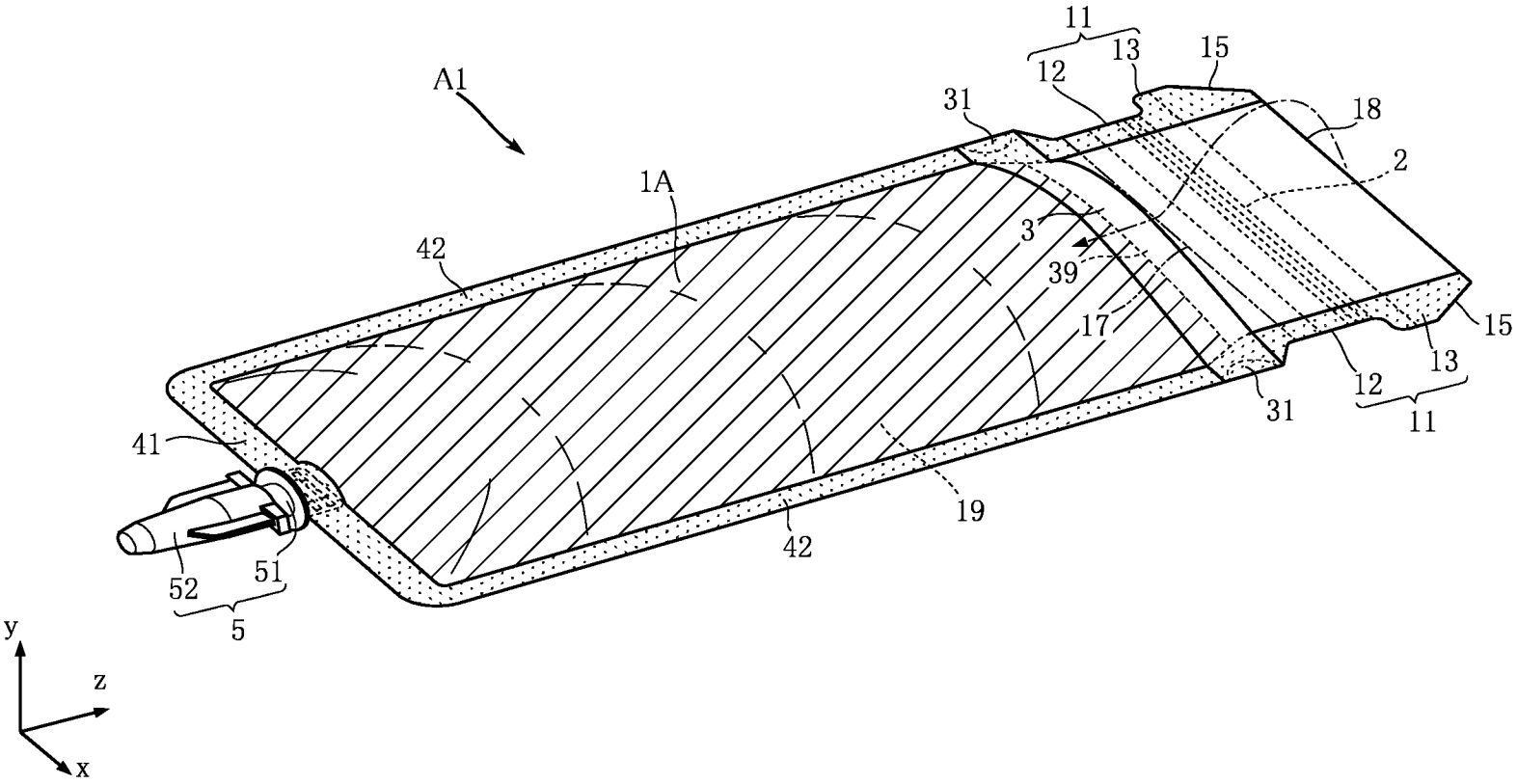
FIG. 9 is a perspective view showing the pouch-type container in use according to the first embodiment of the present invention.
Figure 10:
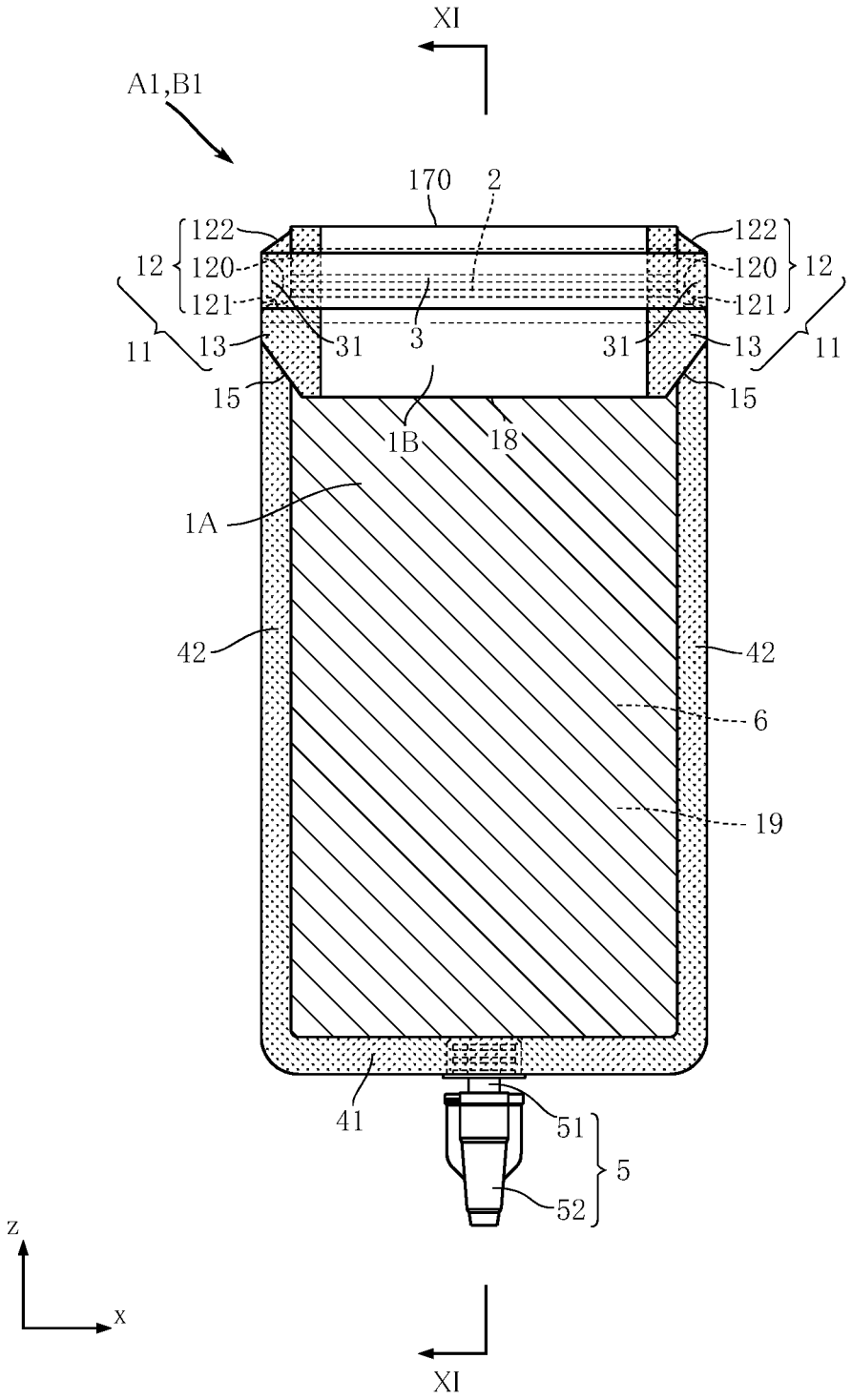
FIG. 10 is a front view of a pouch package according to the first embodiment of the present invention.
Figure 11:
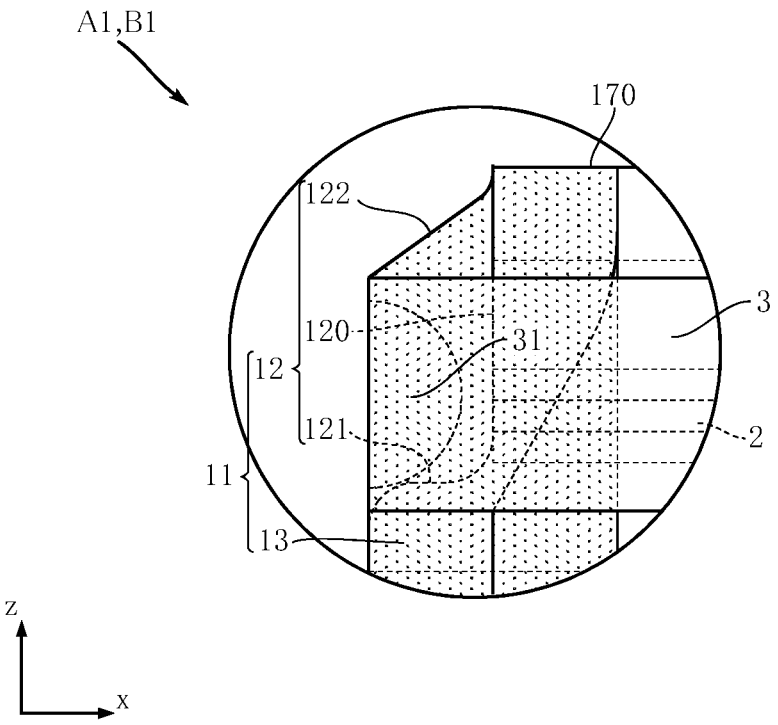
FIG. 11 is an enlarged front view showing a part of the pouch package according to the first embodiment of the present invention.
Figure 12:
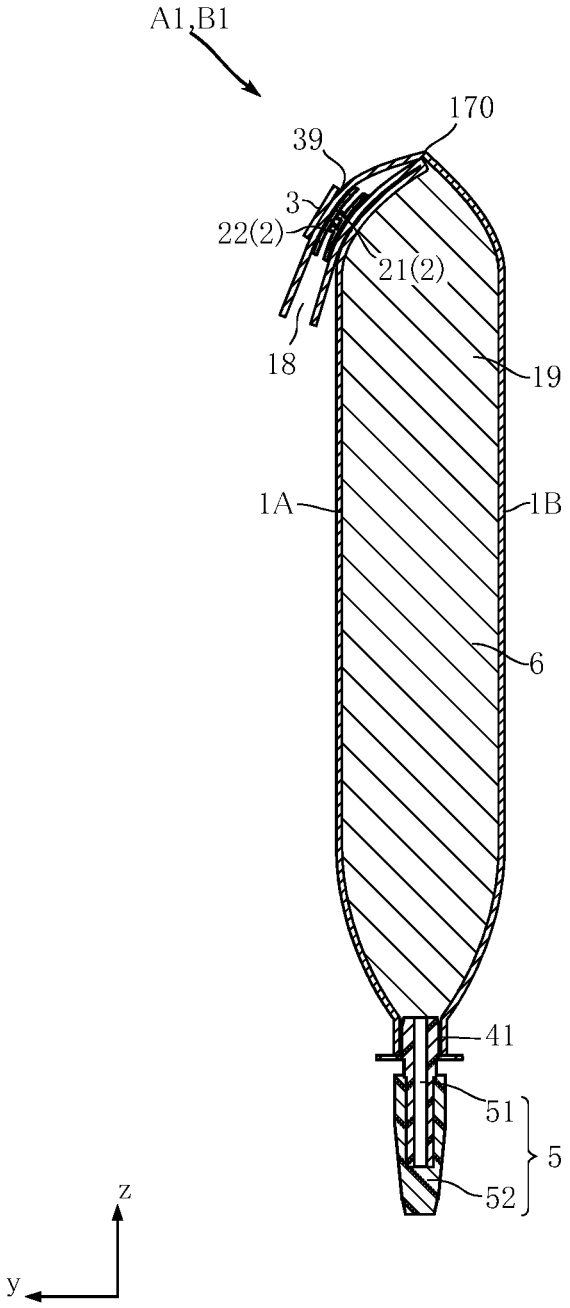
FIG. 12 is a sectional view taken along line XI-XI in FIG. 10.
Figure 13:
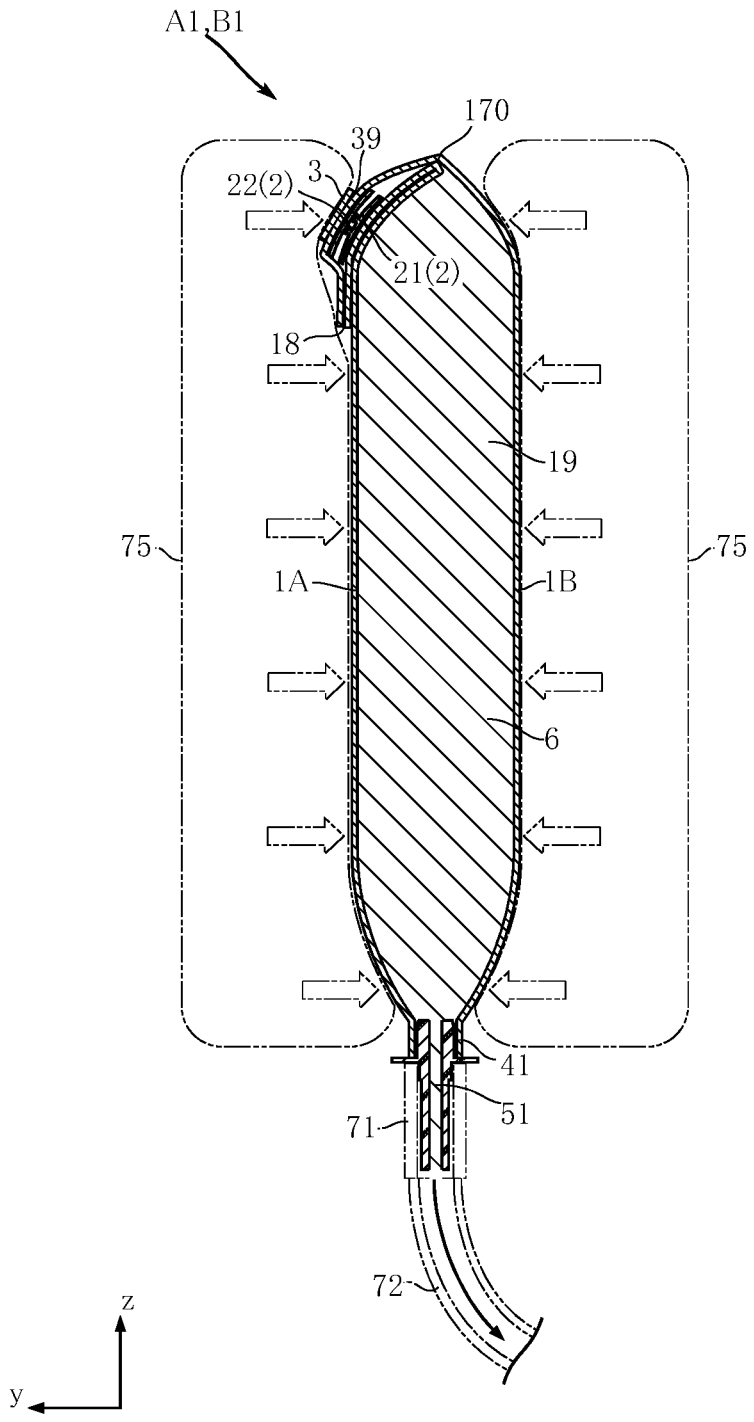
FIG. 13 is a sectional view showing the pouch package in use according to the first embodiment of the present invention.
Figure 14:
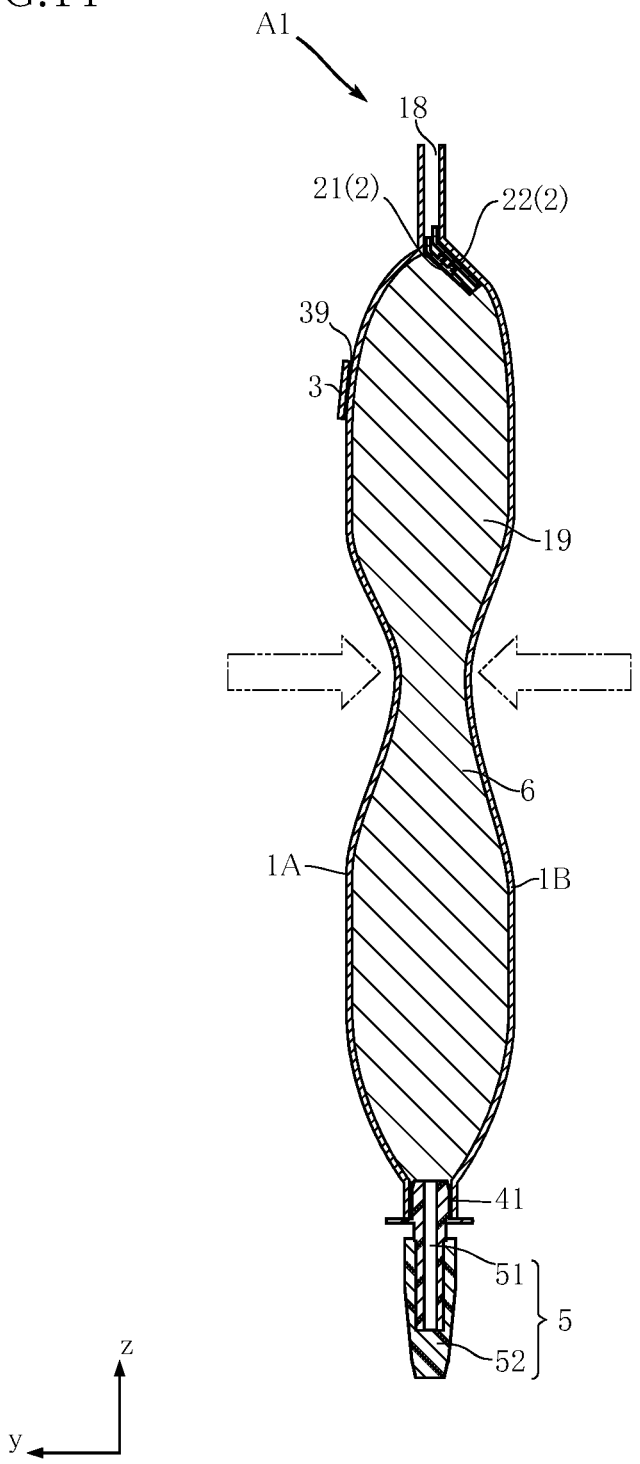
FIG. 14 is a sectional view showing the pouch-type container in use according to the first embodiment of the present invention.
Figure 15:
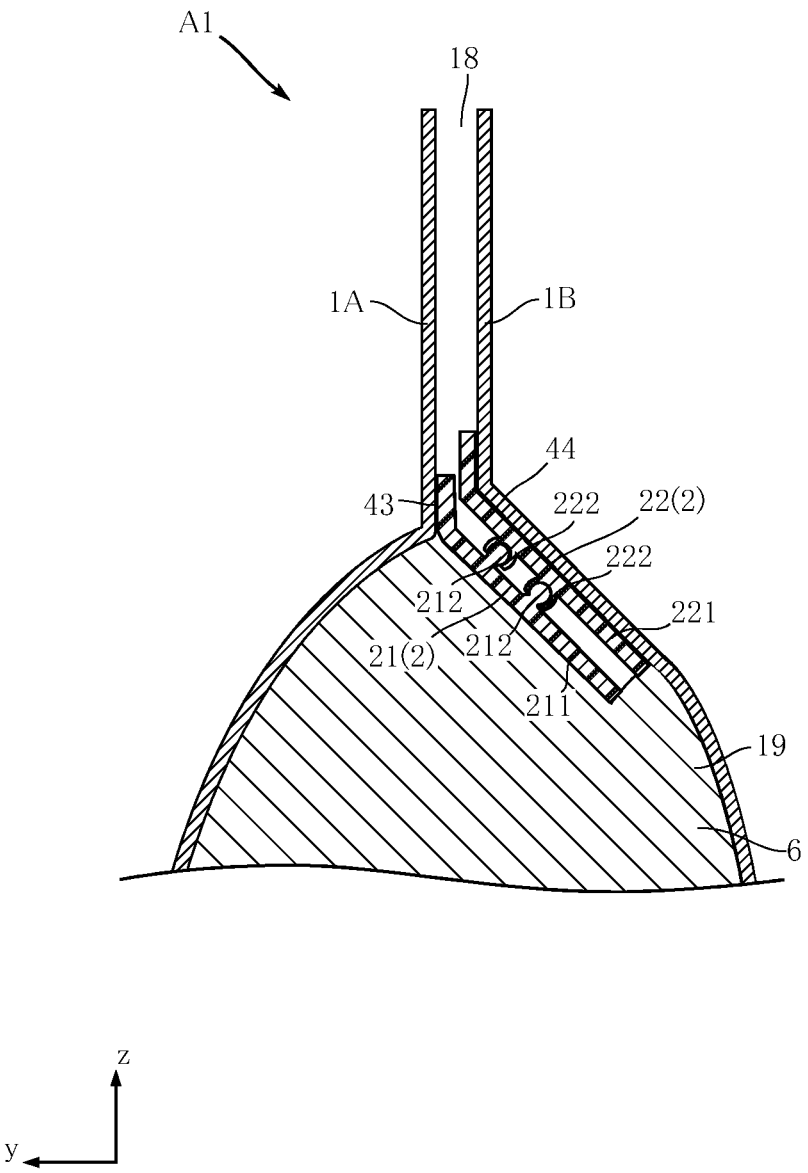
FIG. 15 is a sectional view showing the pouch-type container in use according to the first embodiment of the present invention.

FIG. 1 is a perspective view of the pouch-type container A1. FIG. 2 is a front view of the pouch-type container A1. FIG. 3 is a sectional view taken along line III-III in FIG. 2. FIG. 4 is an enlarged sectional view showing a part of the pouch-type container A1. FIG. 5 is a sectional view taken along line V-V in FIG. 2. FIG. 6 is a front view showing the pouch-type container A1 in use. FIG. 7 is a sectional view taken along line VII-VII in FIG. 6. FIG. 8 is a sectional view showing the pouch-type container A1 in use. FIG. 9 is a perspective view showing the pouch-type container A1 in use. FIG. 10 is a front view of the pouch package B1. FIG. 11 is an enlarged front view showing a part of the pouch package B1. FIG. 12 is a sectional view taken along line XI-XI in FIG. 10. FIG. 13 is a sectional view showing the pouch package B1 in use. FIG. 14 is a sectional view showing the pouch-type container A1 in use. FIG. 15 is an enlarged sectional view showing the pouch-type container A1 in use.

The z direction in these figures corresponds to the "first direction" in the present invention. The y direction is the direction in which the main-body sheets 1A and 1B face each other. The x direction is perpendicular to the y direction and the z direction and corresponds to the "width direction" in the present invention. The z direction can correspond to the vertical direction (up-down direction) depending on the use of the pouch-type container A1 and the pouch package B1, but is not limited to this. In the present embodiment, the z direction corresponds to the vertical direction of the pouch package B1.

As shown in FIG. 2, the pouch-type container A1 shown in the figure is generally rectangular as a whole in front view, but the shape of the pouch-type container A1 is not limited to this. For example, the shape of the pouch-type container A1 in front view may be circular, elliptical, oval (egg-shaped), triangular (preferably inverted triangular), polygonal, or other various shapes. In the illustrated example, the outer edges of the main-body sheets 1A and 1B generally coincide with each other, but these may be partially misaligned.

The main-body sheets 1A and 1B are overlapped in the y-direction, or the front-back direction, to constitute most of the outer surface of the pouch-type container A1. As shown in FIGS. 1 to 3, the bottom edges and nearby portions of the main-body sheets 1A and 1B are joined together to form the bottom sealed part 41. In the illustrated example, a part of the spout 5 is sandwiched between the bottom edges of the main-body sheets 1A and 1B so that the bottom edges of the main-body sheets 1A, 1B and the spout 5 are joined together at the bottom sealed part 41. However, the present disclosure is not limited to this, and the spout 5 may be fixed to the main-body sheets 1A and 1B at a side sealed part 42. Alternatively, the spout 5 may be fixed at the point (i.e., corner) where the bottom sealed part 41 and a side sealed part 42 meet, with an inclination with respect to the x direction and the z direction relative to the main-body sheets 1A and 1B.

As shown in FIGS. 1, 2 and 5, the sides edges and nearby portions of the sheets 1A and 1B are joined together to form the side sealed parts 42. The joining at the bottom sealed part 41 and the side sealed parts 42 may suitably be performed by heat sealing.

The main-body sheets 1A and 1B, the bottom sealed part 41 and the side sealed parts 42 define a storage space 19. The storage space 19 is used to contain the packaged substance 6. An opening 18 is provided at a first end of the main-body sheets 1A and 1B in the z direction. The opening 18 is defined between the end edges of the main-body sheets 1A and 1B at the first end in the z direction.

As shown in FIGS. 1 to 4, the opening/closing part 2 is offset from the opening 18 toward a second or opposite end (i.e., inwardly) in the first direction. The opening/closing part 2 is configured to shift between an open state to open the storage space 19 and a closed state to close the storage space 19. The specific configuration of the opening/closing part 2 is not limited in any way. In the present embodiment, the opening/closing part 2 is made up of a first zip sheet 21 and a second zip sheet 22 fixed to the inner surfaces of the main-body sheets 1A and 1B, respectively, to function like a zipper.

The first zip sheet 21, which is fixed to the inner surface of the main-body sheet 1A, has a support part 211 and a zip part 212. The support part 211 is in the form of a flat strip. The zip part 212 is supported on the support part 211 and formed as a male projection in the illustrated example. In the illustrated example, two zip parts 212 each elongated in the x direction are provided in parallel, spaced apart from each other in the z direction. The number of the zip parts 212 is not limited, and may be one or three or more.

The second zip sheet 22, which is fixed to the inner surface of the main-body sheet 1B, has a support part 221 and a zip part 222. The support part 221 is in the form of a flat strip. The zip part 222 is supported on the support part 221 and formed as a female groove in the illustrated example. In the illustrated example, two zip parts 222 each elongated in the x direction are provided in parallel, spaced apart from each other in the z direction. The number of the zip parts 222 is not limited, and may be one or three or more. The zip part 212 and the zip part 222 can be engaged with and disengaged from each other to achieve the closed state and the open state of the opening/closing part 2.

The technique to fix the first zip sheet 21 and the second zip sheet 22 is not limited. In the present embodiment, an example in which the zip sheets are fixed by heat sealing is explained. In this example, the first zip sheet 21 and the second zip sheet 22 are made of a resin material capable of fixing by heat sealing.

As shown in FIG. 4, the first zip sheet 21 is fixed to the main-body sheet 1A at a first zip-sealed part 43. At the first zip-sealed part 43, the support part 211 of the first zip sheet 21 is fixed to the inner surface of the main-body sheet 1A by heat sealing. In the illustrated example, of the support part 211 of the first zip sheet 21, only the portion offset from the two zip parts 212 toward the first end in the z direction (toward the opening 18) is joined to the inner surface of the main-body sheet 1A to form the first zip-sealed part 43. That is, of the support part 211, the portion provided with the two zip parts 212 and the portion offset from the two zip parts 212 toward the second end in the z direction are not directly attached to the main-body sheet 1A, and are separable from the inner surface of the pouch-type container A1 within the range in which the support part 211 flexes. The specific configuration of the first zip-sealed part 43 at which the first zip sheet 21 is fixed to the main-body sheet 1A is not limited in any way. For example, almost the entirety of the support part 211 of the first zip sheet 21 may be fixed to the main-body sheet 1A. In such a case, the first zip-sealed part 43 may be formed at least at opposite ends of the first zip sheet 21 in the z direction. That is, the first zip sheet 21 may be fixed to the main-body sheet 1A only at the opposite ends in the z direction.

As shown in FIG. 4, the second zip sheet 22 is fixed to the main-body sheet 1B at a second zip-sealed part 44. At the second zip-sealed part 44, almost the entirety of the support part 221 of the second zip sheet 22 is fixed to the inner surface of the main-body sheet 1B by heat sealing. That is, the second zip-sealed part 44 is so provided as to expand over the second zip sheet 22 in manner overlapping with at least the two zip parts 222. Thus, the two zip parts 222 are not separable from the inner surface of the main-body sheet 1B. The specific configuration of the second zip-sealed part 44 at which the second zip sheet 22 is fixed to the main-body sheet 1B is not limited in any way. As a configuration in which almost the entirety of the second zip sheet 22 is fixed to the main-body sheet 1B, the second zip-sealed part 44 may be formed at least at opposite ends of the second zip sheet 22 in the z direction. That is, the second zip sheet 22 may be fixed to the main-body sheet 1B only at the opposite ends in the z direction. Moreover, when almost the entirety of the first zip sheet 21 is fixed to the main-body sheet 1A, the second zip-sealed part 44 may be formed only at the portion of the second zip sheet 22 that is offset from the zip parts 222 toward the first end (toward the opening 18) in the z direction so that the zip parts 222 are separable from the main-body sheet 1B.

As shown FIGS. 1 to 3, the spout 5 is provided at the second end, opposite the opening 18, of the main-body sheets 1A and 1B in the z direction. The spout 5 is used to discharge the packaged substance 6 from the storage space 19 in the pouch package B1 prepared by using the pouch-type container A1. The specific configuration of the spout 5 is not limited in any way. In the present embodiment, the spout 5 includes a body 51 and a cap 52. The spout of the present invention is not limited to that made separately from the main-body sheets 1A and 1B, and may be made of a part of the main-body sheet 1A and/or the main-body sheet 1B. The body 51 is internally formed with a through-hole for discharging the packaged substance 6. As mentioned before, a part of the body 51 may be sandwiched between and joined to the main-body sheet 1A and the main-body sheet 1B. In this case, the body 51 (spout 5) is made of a heat sealable resin such as PP (polypropylene), for example.

The cap 52 is used to close the through-hole of the body 51 and removed from the body 51 in discharging the packaged substance 6. In the illustrated example, the cap 52 is formed with a fin-shaped part. The cap 52 can be removed from the body 51 by twisting the cap 52 with fingers placed on the fin-shaped part, for example.

As shown in FIGS. 1 to 3 and 5, the locking band 3 is elongated in the x direction and fixed to the main-body sheets 1A and 1B at a pair of fixed portions 31. The locking band 3 defines an insertion space 39 with the main-body sheet 1A as one of the paired main-body sheets 1A and 1B. The material for the locking band 3 is not limited, and various materials such as resin sheet, cloth material, or paper may be used. Hereinafter, the locking band 3 made of a heat sealable resin material, as with the main-body sheets 1A and 1B, is explained as an example. In preparing or using the pouch package B1 as described below, the pouch-type container A1 or the pouch package B1 may be suspended by hanging the locking band 3 on a hook (not shown), for example. For such a purpose, a material that is strong enough to support the weight of the pouch package B1 containing the packaged substance 6 is preferably chosen for the locking band 3.

In the present embodiment, the fixed portions 31 are provided on the opposite sides of the storage space 19 in the x direction. The technique to form the fixed portions 31 is not limited in any way, and heat sealing or an adhesive may be used as appropriate. In the present embodiment, an example in which the fixed portions 31 are formed by heat sealing along with the side sealed parts 42 is explained. Note that one or both of the fixed portions 31 may be provided on the inner side of the side sealed parts 42 in the x direction. In the illustrated example, as shown in FIGS. 2 and 5, the main-body sheet 1A is formed with semicircular notches on the opposite ends in the x direction, and the inner surface of the main-body sheet 1B and the inner surface of the locking band 3 are joined together through the notches by heat sealing. The shape of the fixed portions 31 is not limited, and may be semicircular as viewed in the y direction as shown in FIGS. 2 and 5 or may be circular, elliptical, oval (egg-shaped), square, polygonal, or other various shapes. The fixed portions 31 may be provided throughout the length of the locking band 3 in the z direction or may be provided at a part of the length in the z direction. In the present embodiment, the fixed portions 31 are provided at the center of the locking band 3 in the z direction. That is, the locking band 3 is not joined to the main-body sheet 1A at portions above and below the fixed portions 31 in the z direction. The configuration of the fixed portions 31 is not limited in any way. For example, unlike the configuration described above, the ends of the locking band 3 may be joined to the outer surface of the main-body sheet 1A or the main-body sheets 1B with an adhesive, for example. The ends of the locking band 3 may be joined to the outer surface of the main-body sheet 1A with an adhesive, in addition to the inner surface of the main-body sheet 1B. The ends of the locking band 3 may be joined to the outer surfaces of both the main-body sheet 1A and the main-body sheet 1B with an adhesive, for example, in such a manner as to wrap around the ends of the main-body sheet 1B from the main-body sheet 1A. One of the fixed portions 31 may be provided by a different manner from the other one.

The lock part 11 is made of at least one of the main-body sheets 1A and 1B. The lock part 11 is the portion to be locked with the locking band 3 by being inserted into the insertion space 39, with the main-body sheets 1A and 1B folded back. The specific configuration of the lock part 11 is not limited in any way. In the present embodiment, the lock part 11 includes a constricted portion 12 and a wider portion 13, as shown in FIGS. 1 and 2. In the present embodiment, the lock part 11 is made of a portion of each of the main-body sheets 1A and 1B. However, the lock part 11 is not limited to such a configuration and may be made of a portion of either one of the main-body sheets 1A and 1B.

The constricted portion 12, which is a part of at least one of the main-body sheets 1A and 1B, has a minimum width W1 in the x direction that is smaller than the distance W0 between the fixed portions 31 in the x direction. In the present embodiment, the constricted portion 12 is made of a portion of each of the main-body sheets 1A and 1B, and has a base edge 120, a first edge 121 and a second edge 122. The base edge 120 is the edge located inward in the x direction. The first edge 121 is offset from the base edge 120 toward the first end (toward the opening 18) in the z direction. The second edge 122 is offset from the base edge 120 toward the second end in the z direction. Each of the base edge 120, the first edge 121 and the second edge 122 may be a straight line, a curved line, a bent line, or in other shapes as appropriate. For example, the base edge 120, the first edge 121 and the second edge 122 may form a continuous curved line. In the illustrated example, the inclination angle of the first edge 121 with respect to the z direction is larger than the inclination angle of the second edge 122 with respect to the z direction. For example, while the inclination angle of the first edge 121 with respect to the z direction is about 90°, the inclination angle of the second edge 122 with respect to the z direction is about 45°. In the illustrated example, the constricted portion 12 has the base edge 120, the first edge 121 and the second edge 122 on each of the opposite sides in the x direction, but the configuration of the constricted portion 12 is not limited to this. For example, the base edge 120, the first edge 121 and the second edge 122 may be provided on only one side in the x direction.

The wider portion 13 is made of at least one of the main-body sheets 1A and 1B, and made of a portion of each of the main-body sheets 1A and 1B in the present embodiment. The wider portion 13 is offset from the constricted portion 12 toward the first end (toward the opening 18) in the z direction, and has a width W2 in the x direction that is larger than the distance W0 between the fixed portions 31 in the x direction. In the illustrated example, the wider portion 13 has a shape projecting toward the opposite sides in the x direction relative to the constricted portion 12. The wider portion 13 may project toward only one side in the x direction relative to the constricted portion 12.

As shown in FIG. 2, in the present embodiment, the opening/closing part 2 is provided at a position overlapping with the constricted portion 12 as viewed in the y direction. The main-body sheets 1A and 1B are to be folded back along a fold line 17 in preparing the pouch package B1 described below. In the illustrated example, the fold line 17 is located between the opening/closing part 2 and the locking band 3 in the z direction and at a position overlapping with the constricted portion 12. More specifically, the fold line 17 is formed at a position overlapping with the base edge 120. The position of the fold line 17 is not particularly limited and may be at any position offset toward the other side in the z direction with respect to the opening/closing part 2 and also between the opening/closing part 2 and the locking band 3 in the z direction that allows proper folding of the main-body sheets 1A and 1B during preparation of the pouch package B1.

In the present embodiment, the pouch-type container A1 has a pair of oblique edges 15. The oblique edges 15 are offset from the wider portion 13 toward the first end in the z direction. The paired oblique edges 15 are inclined in such a manner as to decrease the distance therebetween in the x direction as proceeding toward the first end in the z direction (toward the opening 18). Note that the oblique edges 15 may not be provided, or only a single oblique edge 15 may be provided.

Each of the sheets making the pouch-type container A1 is typically a rein film. The resin film forming the sheets needs to have basic properties required of a packaging material, such as impact resistance, abrasion resistance and heat resistance. Moreover, since the sealed parts and joined parts described above are typically formed by heat sealing, the sheets are required to have heat sealability. Thus, as the sheet, a multilayer sheet including a base-film layer and a sealant layer that imparts heat sealability may be suitable. When high gas barrier performance and high light-shielding performance are needed, a barrier layer may be provided between the base-film layer and the sealant layer. Such barrier characteristics may be imparted on the base-film layer itself. In such a case, the barrier layer serves as the base-film layer, so that the multilayer sheet is made up of the barrier layer and the sealant layer. To impart heat sealability to both sides of a sheet, a monolayer film, described below, that can be used as the sealant layer may be used, or a multilayer sheet made up of two same or different types of sealant layers (one of which is used as the base-film layer) may be used. Alternatively, a multilayer sheet having sealant layers on both sides of a base-film layer may be used. In the present embodiment, a multilayer sheet made up of a base-film layer forming the outer surface and a sealant layer forming inner side is used for the main-body sheets 1A, 1B and the locking band 3.

Examples of the materials for the base-film layer, the sealant layer and the gas barrier layer are described below. Note that these layers can be laminated by a conventional lamination technique, such as dry lamination with adhesives, lamination with solvent-free adhesives, thermal lamination in which the layers are thermally bonded together with a thermal adhesive layer sandwiched therebetween, or extrusion lamination in which a resin layer, which will be the sealant layer, is extruded onto the base-film layer.

Examples of the filmmaking the base-film layer include oriented or non-oriented, single-layer or multi-layer films made from polyester (such as polyethylene terephthalate (PET), polyethylene naphthalate (PEN), and polybutylene terephthalate (PBT)), polyolefin (such as polyethylene (PE) and polypropylene (PP)), polyamide (such as Nylon-6 and Nylon-66), polyacrylonitrile (PAN), polyvinyl chloride (PVC), and polyvinylidene chloride (PVDC), and in particular, biaxially oriented PET films and biaxially oriented polyamide films with a thickness of 9 to 30 μm are preferable.

Examples of the resin layer making the sealant layer include single-layer or multi-layer films or extruded resin films made from low-density polyethylene (LDPE), linear low-density polyethylene (LLDPE), high-density polyethylene (HDPE), ethylene-propylene copolymer (EP), cast polypropylene (CPP), ethylene-olefin copolymer, ethylene acrylic acid (EAA) copolymer, ethylene-methyl methacrylate (EMMA) copolymer, and ethylene-vinyl acetate (EVA) copolymer. Preferably, the sealant layer is 20 to 150 μm, and preferably, 40 to 120 μm in thickness.

Examples of the gas barrier layer include a film provided by depositing (or sputtering) aluminum or inorganic oxide such as aluminum oxide or silica on a thin film of metal such as aluminum or a film of resin such as polyvinylidene chloride (PVDC), ethylene vinyl alcohol (EVOH) copolymer or other synthetic resin (which may be the base-film layer).

The main-body sheets 1A and 1B may be provided with scales (not shown) for measuring the amount of nutrients as the packaged substance. In addition to the scales, the main-body sheets may be provided with a print layer for indicating the product name, ingredients, or precautions for use, for example. The print layer may be provided on the base-film layer by gravure printing or flexographic printing.

FIGS. 6 to 15 show the pouch-type container A1 in use and also show how to prepare the pouch package B1 using the pouch-type container A1.

First, as shown in FIGS. 6 and 7, the opening/closing part 2 is set to the open state to open the opening 18. In the state shown in the figures, the z direction, which is the first direction, is along the vertical direction. Next, the packaged substance 6 is loaded into the storage space 19 through the opening 18. In the present embodiment, the packaged substance 6 is nutrients in liquid state. The loading amount of the packaged substance 6 is not limited, but at least the liquid level should be positioned below the opening/closing part 2 in the z direction.

Next, as shown in FIG. 8, the zip part 212 of the first zip sheet 21 and the zip part 222 of the second zip sheet 22 are brought into engagement to close the opening/closing part 2. Thus, the storage space 19 is closed while containing therein the packaged substance 6. In this state, the packaged substance 6 is hermetically sealed in the storage space 19.

Next, with the upper ends of the main-body sheets 1A and 1B in the z direction held with fingers, the main-body sheets 1A and 1B are folded back along the fold line 17, as shown in FIG. 9. In this process, the main-body sheets 1A and 1B are folded such that the main-body sheet 1A is on the inside (valley side) and the main-body sheet 1B is on the outside (mountain side). Next, the ends of the main-body sheets 1A and 1B are inserted into the insertion space 39. During the insertion, the main-body sheets 1A and 1B are passed between the paired fixed portions 31, from the ends and then the wider portion 13. The insertion process is completed when the constricted portion 12 is located between the fixed portions 31. Thus, as shown in FIGS. 10 and 12, the lock part 11 is locked with the locking band 3, with the main-body sheets 1A and 1B folded at a folding portion 170. In this way, the pouch package B1 is completed.

As shown in FIG. 10, in the present embodiment, the locking engagement between the lock part 11 and the locking band 3 is achieved by positioning the wider portion 13 below the fixed portions 31 in the z direction. Specifically, reliable locking is realized by the paired first edges 121 engaging with the paired fixed portions 31 from below in the z direction.

FIG. 13 shows an example of use of the pouch package B1. The cap 52 of the spout 5 is removed from the body 51, and a spout nozzle 71 is attached to the body 51. A discharging pipe 72 is connected to the spout nozzle 71. The discharging pipe 72 is used to guide the packaged substance 6 discharged through the body 51 to the patient in the PEG. Pressurizers 75 are disposed on opposite sides of the pouch package B1 (storage space 19) in the y direction. The pressurizers 75 are used to apply to the pouch package B1 a pressure to discharge the packaged substance 6. In the illustrated example, the pressurizers 75 are configured to apply a pressure to the area including the locking band 3 and the lock part 11.

The pressure applied by the pressurizers 75 is adjusted such that the packaged substance 6 is discharged at a desired rate. By the pressurization with the pressurizers 75, the packaged substance 6 is discharged from the storage space 19 of the pouch-type container A1 through the body 51 of the spout 5. The packaged substance 6 is guided through the discharging pipe 72 to the patient and supplied into the patient's body in the PEG.

Advantages of the pouch-type container A1 and the pouch package B1 are described below.

According to the present embodiment, in the pouch package B1 prepared using the pouch-type container A1, the lock part 11 is locked with the locking band 3, with the main-body sheets 1A and 1B folded at the folding portion 170, as shown in FIGS. 10 and 12. With such a configuration, during the pressurization of the pouch package B1 with the pressurizers 75, the folded state of the main-body sheets 1A and 1B is reliably maintained, as shown in FIG. 13. Thus, even when the packaged substance 6 reaches the opening/closing part 2 due to the pressure by the pressurizers 75, the opening/closing part 2 is prevented from being opened by the pressure of the packaged substance 6. Thus, leakage of the packaged substance 6 due to the pressurization is prevented, and the packaged substance 6 is reliably discharged.

As shown in FIG. 13, since the pressurizers 75 pressurizes the area including the locking band 3 and the lock part 11, the main-body sheets 1A and 1B can reliably maintain the state folded at the folding portion 170. This is advantageous for preventing the leakage of the packaged substance 6 and properly discharging the packaged substance 6.

As shown in FIGS. 1 and 2, the lock part 11 has the constricted portion 12 and the wider portion 13. The width W1 of the constricted portion 12 is smaller than the distance W0 between the fixed portions 31. This allows the constricted portion 12 to be positioned between the fixed portions 31 to overlap with the locking band 3 in the pouch package B1, as shown in FIGS. 10 and 12. The width W2 of the wider portion 13 is larger than the distance W0 between the fixed portions 31. With such a configuration, after the wider portion 13 is passed, following the ends of the main-body sheets 1A and 1B, between the fixed portions 31 toward the second end in the z direction, the wider portion 13 is caught on the fixed portions 31, as shown in FIG. 10. Thus, the lock part 11 and the locking band 3 are firmly locked together, which is advantageous in maintaining the folding at the folding portion 170.

As shown in FIG. 2, the constricted portion 12 has the first edges 121. The inclination angle of the first edges 121 with respect to the z direction is larger than that of the second edges 122. Thus, as shown in FIG. 10, when the lock part 11 (the wider portion 13) is locked to the fixed portions 31, the first edges 121 reliably engage with the fixed portions 31 on their second-end side in the z direction. This is advantageous in firmly locking the lock part 11 and the locking band 3. The portions of the locking band 3 that are positioned above and below the fixed portions 31 in the z direction are not joined to the surface of the main-body sheet 1A. As shown in FIG. 11, the first edges 121 of the constricted portion 12 are received in the non-joined portions. Thus, the first edges 121 will are prevented from being caught during the use of the pouch package B1 (e.g. during insertion into and removal from a holder (e.g., pressurizers 75) for the pouch package B1).

As shown in FIGS. 1, 2 and 10, the fixed portions 31 are provided on the opposite sides of the storage space 19 in the x direction. Such an arrangement allows a large dimension of the insertion space 39 in the x direction and also allows a large width W1 of the constricted portion 12 of the lock part 11. This is advantageous in realizing and maintaining the folded state of the main-body sheets 1A and 1B along the entire width in the x direction by the locking engagement between the lock part 11 and the locking band 3.

Making the lock part 11 (the constricted portion 12 and the wider portion 13) from portions of both the main-body sheets 1A and 1B can improve the rigidity of the lock part 11. This is advantageous in firmly locking the lock part 11 and the locking band 3.

The fixed portions 31 are formed by heat-sealing the opposite ends of the locking band 3 in the x direction and the main-body sheet 1B at the side sealed parts 42. That is, the fixed portions 31 form portions of the side sealed parts 42, which improves the joining strength of the locking band 3 to the main-body sheets 1A, 1B.

As shown in FIG. 4, the first zip-sealed part 43, at which the first zip sheet 21 and the main-body sheet 1A are fixed, is provided only at the portion that is offset from the zip part 212 of the first zip sheet 21 toward the first end in the z direction. On the other hand, the second zip-sealed part 44, at which the second zip sheet 22 and the main-body sheet 1B are fixed, is provided at the entirety of the support part 221 to overlap with the zip part 222. As shown in FIGS. 14 and 15, in preparing the pouch package B1 using the pouch-type container A1, strong pressure may be unintentionally applied to the storage space 19 before the main-body sheets 1A and 1B are folded along the fold line 17. In such a case, since the above-described folding portion 170 has not been formed yet, the pressure of the packaged substance 6 is transmitted to the opening/closing part 2. The pressure can act to push apart the main-body sheets 1A and 1B.

In the present embodiment, as shown in FIG. 15, of the support part 211 of the first zip sheet 21, the portion provided with the two zip parts 212 and the portion offset from the two zip parts 212 toward the second end in the z direction are not directly attached to the main-body sheet 1A, and are separable from the inner surface of the pouch-type container A1 within the range in which the support part 211 flexes. Thus, a portion of the first zip sheet 21 can separate from the main-body sheet 1A, with the pressure of the packaged substance 6 applied thereto. The pressure is received by the first zip-sealed part 43, i.e., the region at which the main-body sheet 1A and the first zip sheet 21 are joined. The first zip-sealed part 43, which is formed by heat sealing, has higher strength and more excellent sealing property than the engagement between the first zip sheet 21 and the second zip sheet 22. The pressure of the packaged substance 6 is unlikely to exert on the engaged portion between the zip part 212 of the first zip sheet 21 and the zip part 222 of the second zip sheet 22, so that the first zip sheet 21 and the second zip sheet 22 are unlikely to be pushed apart. Thus, leakage of the packaged substance 6 is prevented even when such unintentional pressure is applied.

FIGS. 16 to 20 show variations and other embodiments of the present invention. In these figures, the elements that are identical or similar to those of the foregoing embodiment are denoted by the same reference signs as those used for the foregoing embodiment.

First Embodiment First Variation

Figure 16:
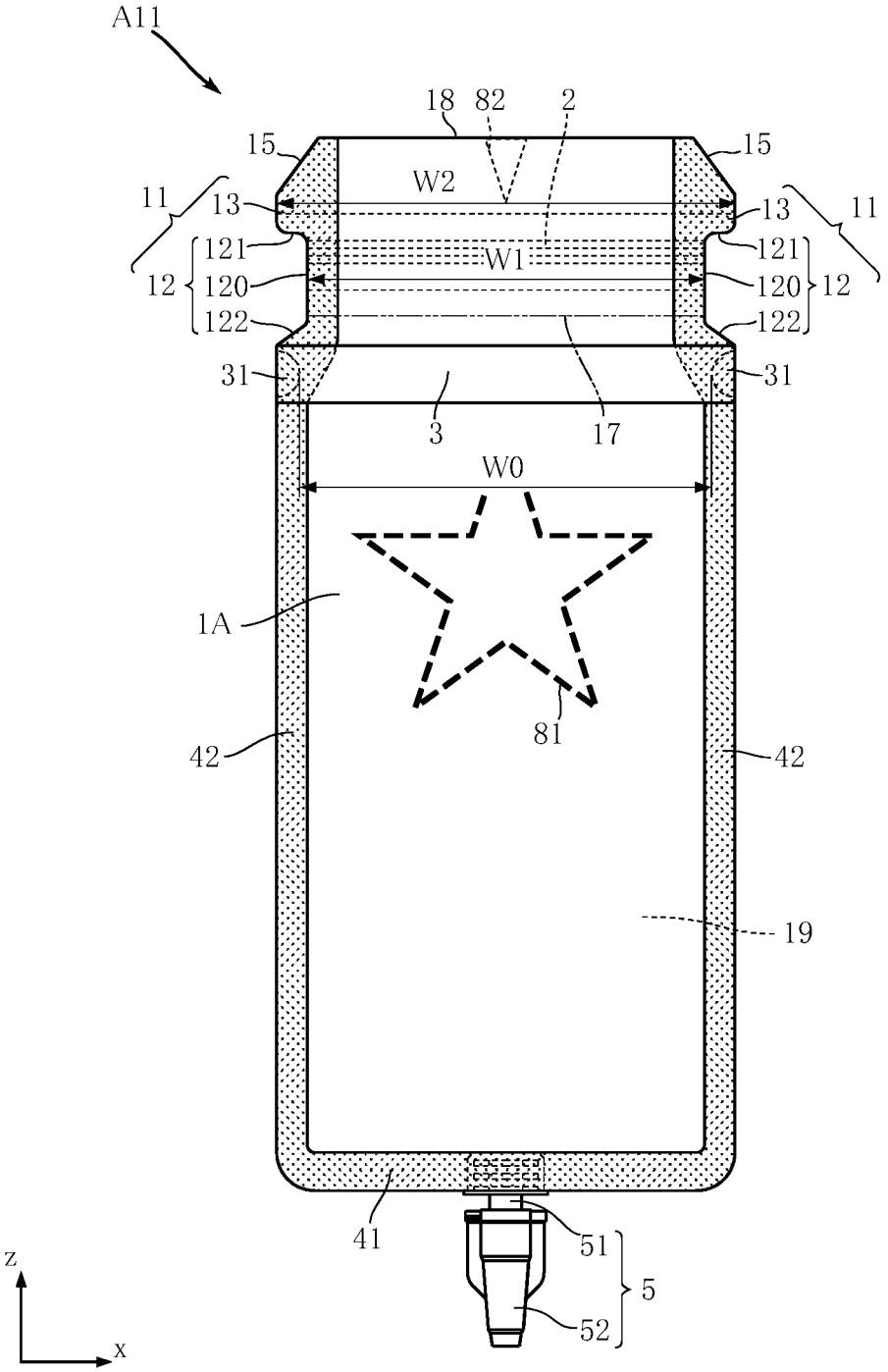
FIG. 16 is a front view showing a first variation of the pouch-type container according to the first embodiment of the present invention.
Figure 17:
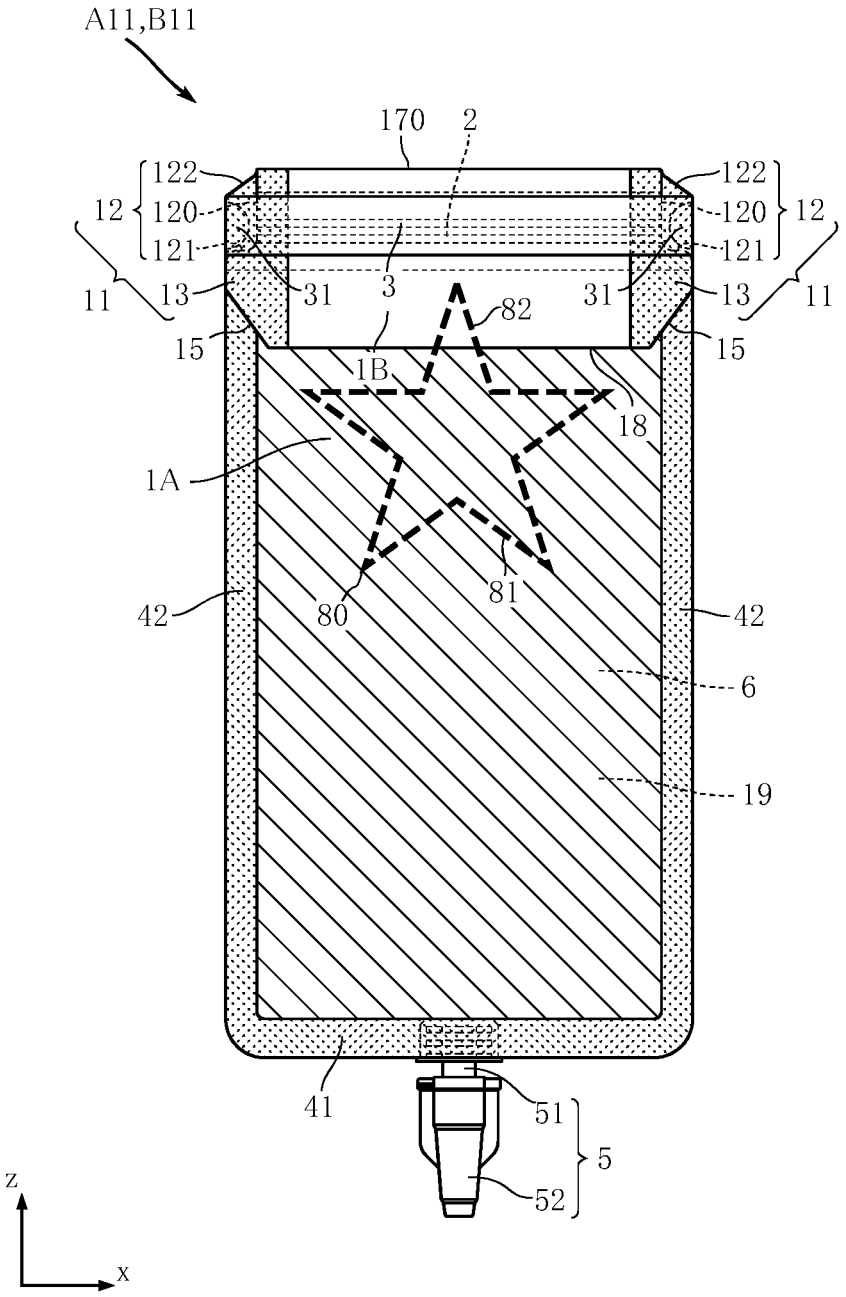
FIG. 17 is a front view showing a first variation of the pouch package according to the first embodiment of the present invention.

FIGS. 16 and 17 show a first variation of the pouch-type container A1 and the pouch package B1. In this variation, the pouch-type container A11 has a first indication 81 and a second indication 82.

As shown in FIG. 16, the first indication 81 is visible on the outer surface of the main-body sheet 1A. The second indication 82 is visible on the outer surface of the main-body sheet 1B. In the illustrated example, the first indication 81 is provided on the main-body sheet 1A at a portion offset from the locking band 3 toward the second end in the z direction, and is a part of a star mark formed by printing, for example. The second indication 82 is provided on the main-body sheet 1B at a portion near the first end in the z direction, and is a remaining part of the star mark formed by printing, for example.

As shown in FIG. 17, in the pouch package B11 prepared by using the pouch-type container A11, the main-body sheets 1A and 1B are folded such that the first indication 81 and the second indication 82 are combined to form a combined indication 80. The combined indication 80 in the illustrated example is a star mark, which is formed by the first indication 81 and the second indication 82 combined together. The shape of the combined indication 80 formed by combining the first indication 81 and the second indication 82 is not limited, and various shapes may suitably be used that are more familiar or noticeable to a user than when each of the first indication 81 and the second indication 82 is seen by itself.

The present variation provides the same advantages as those of the pouch-type container A1 and the pouch package B1. In addition, when the folding along the fold line 17 is not performed during the preparation of the pouch package B11, the first indication 81 or the second indication 82 will be seen by itself, which can provide the user with a sense of strangeness or unfulfillment, thereby prompting the user to perform the folding along the fold line 17. This is advantageous in preventing the misuse of the pouch package without the folding along the fold line 17 or without the locking engagement between the lock part 11 and the locking band 3.

First Embodiment Second Variation

Figure 18:
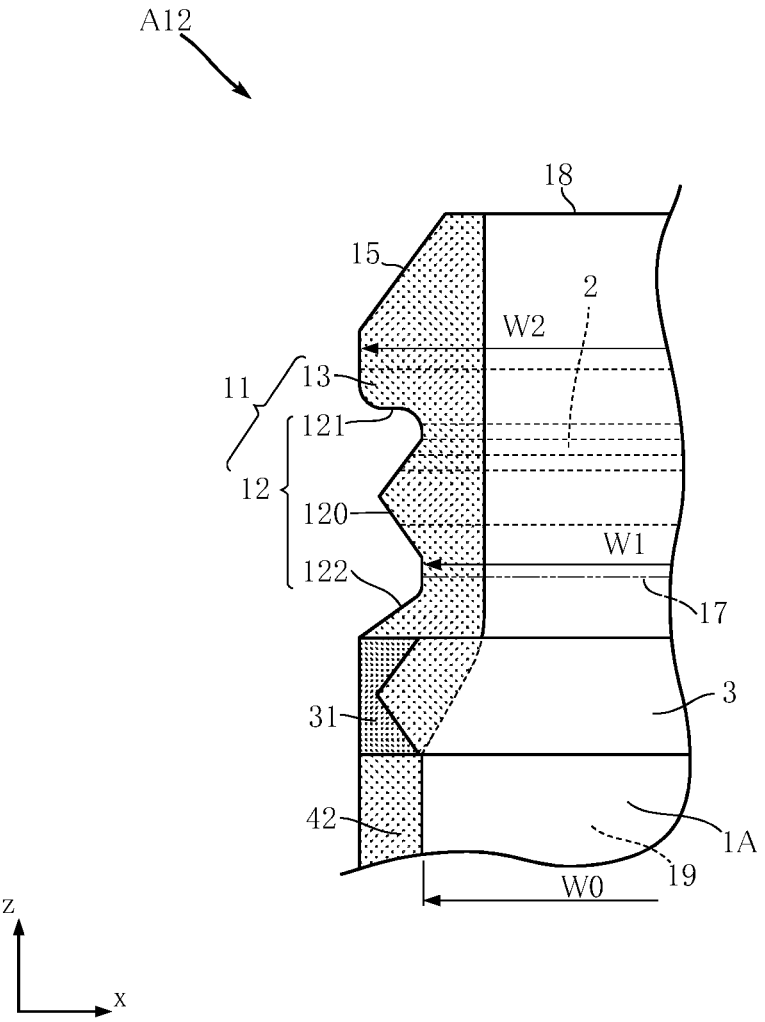
FIG. 18 is a front view showing a second variation of the pouch-type container according to the first embodiment of the present invention.

FIG. 18 shows a second variation of the pouch-type container A1. The pouch-type container A12 of the present variation differs from the foregoing examples in shape of the constricted portion 12 and the fixed portion 31.

The constricted portion 12 of this variation has a base edge 120 bent to project outward in the x direction at the center in the z direction. The fixed portion 31 of the present variation is dented at the center in the z direction so that the inner edge in the x direction is bent outward in the x direction.

The present variation provides the same advantages as those of the pouch-type container A1 and the pouch package B1. Moreover, in locking the lock part 11 to the fixed portion 31 of the locking band 3, the bent base edge 120 fits to the dented part of the fixed portion 31. This realizes more reliable locking engagement between the lock part 11 and the fixed portion 31.

Second Embodiment

Figure 19:
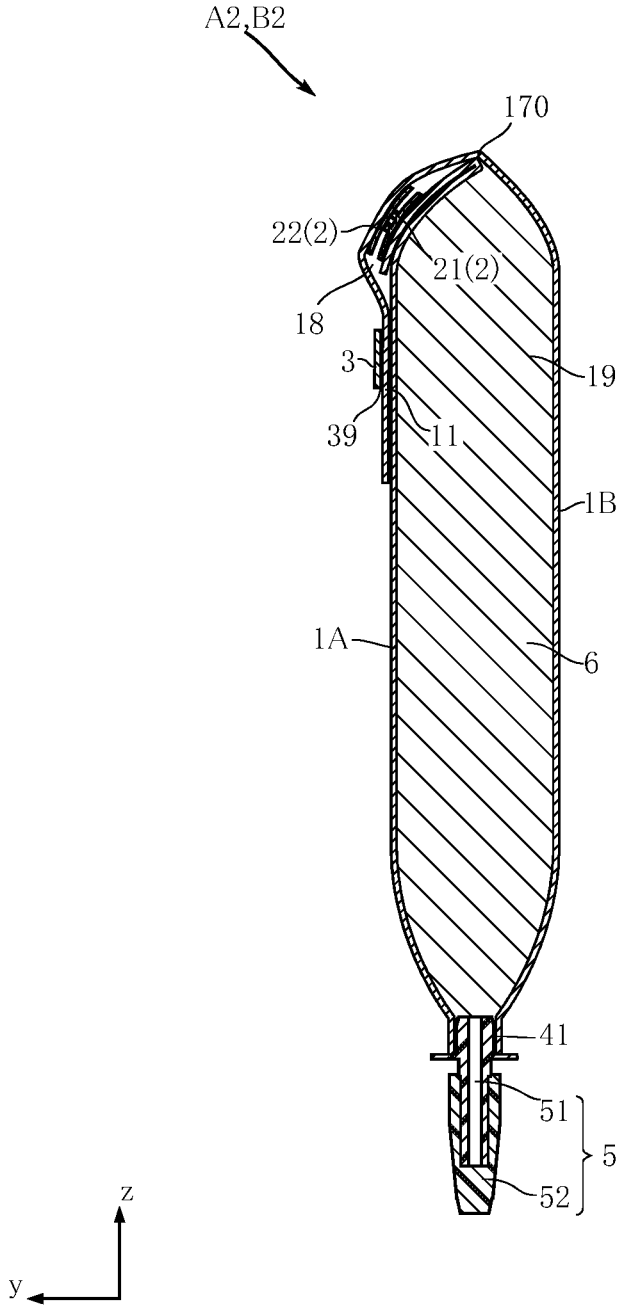
FIG. 19 is a sectional view showing a pouch-type container and a pouch package according to a second embodiment of the present invention.

FIG. 19 shows a pouch-type container and a pouch package according to a second embodiment of the present invention. In the pouch-type container A1 of the present embodiment, the lock part 11 is made of the main-body sheet 1B alone, and the lock part 11 does not include the main-body sheet 1A. In one example, the main-body sheet 1B alone is formed with the constricted portion 12 and the wider portion 13 as shown in FIG. 2. In the present embodiment, the lock part 11 is provided at a position that does not overlap with the opening/closing part 2 and offset from the opening/closing part 2 toward the first end in the z direction in the pouch-type container A1.

In the pouch package B2, the main-body sheets 1A and 1B are folded back at the folding portion 170, and the lock part 11 made of the main-body sheet 1B is locked with the locking band 3.

In the present embodiment again, the packaged substance 6 is reliably discharged by pressurization. As will be understood from the present embodiment, the lock part 11 may be made of the main-body sheet 1B alone. This is achieved by selecting, for example, the material and thickness of the main-body sheet 1B and the shapes of the lock part 11 and the locking band 3 (fixed portions 31) such that the lock part 11 and the locking band 3 are properly engageable. In use as shown in FIG. 13, even with the lock part 11 made of the main-body sheet 1B alone, the folded state of the folding portion 170 is reliably maintained during the pressurization with pressurizers 75.

Second Embodiment First Variation

Figure 20:
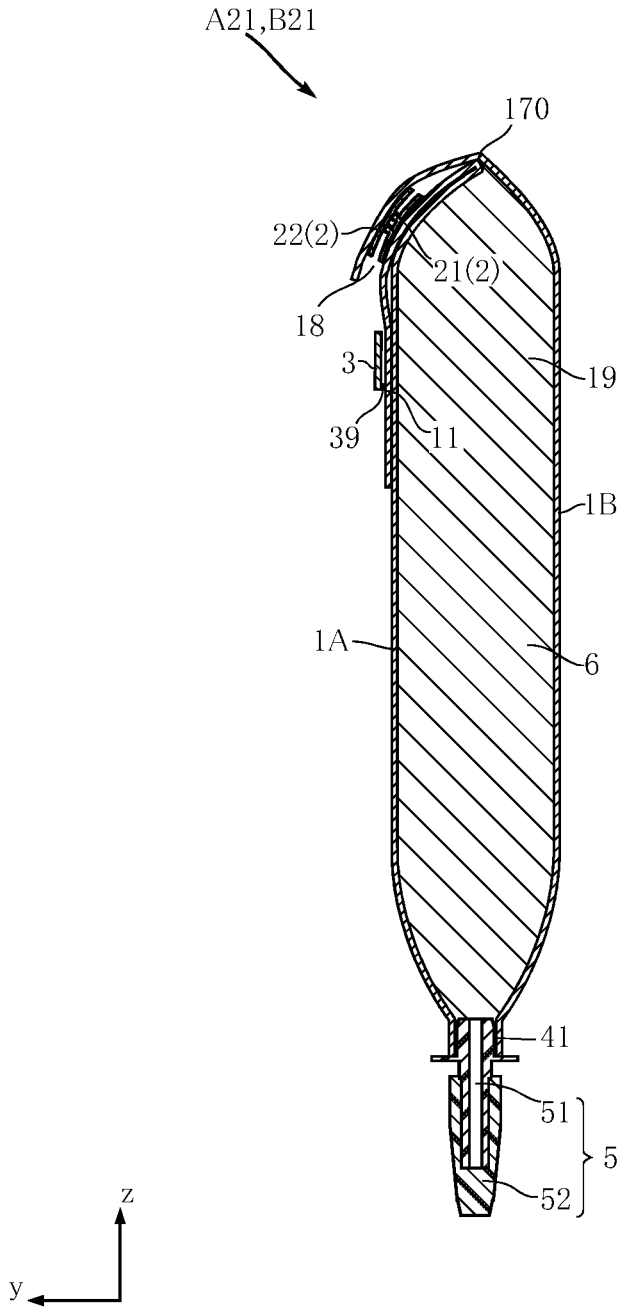
FIG. 20 is a sectional view showing a first variation of the pouch-type container and the pouch package according to the second embodiment of the present invention.

FIG. 20 shows a first variation of the pouch-type container A2 and the pouch package B2. In the pouch-type container A21 of the present variation, the lock part 11 is made of the main-body sheet 1A alone, and the lock part 11 does not include the main-body sheet 1B. In one example, the main-body sheet 1A alone is formed with the constricted portion 12 and the wider portion 13 as shown in FIG. 2. In the present embodiment, the lock part 11 is provided at a position that does not overlap with the opening/closing part 2 and offset from the opening/closing part 2 toward the first end in the z direction in the pouch-type container A1.

In the pouch package B21, the main-body sheets 1A and 1B are folded back at the folding portion 170, and the lock part 11 made of the main-body sheet 1A is locked with the locking band 3.

In the present embodiment again, the packaged substance 6 is reliably discharged by pressurization. As will be understood from the present embodiment, the lock part 11 may be made of the main-body sheet 1A alone. This is achieved by selecting, for example, the material and thickness of the main-body sheet 1A and the shapes of the lock part 11 and the locking band 3 (fixed portions 31) such that the lock part 11 and the locking band 3 are properly engageable. In use as shown in FIG. 13, even with the lock part 11 made of the main-body sheet 1A alone, the folded state of the folding portion 170 is reliably maintained during the pressurization with pressurizers 75.

The pouch-type container and the pouch package according to the present invention are not limited to the foregoing embodiments. The specific configuration of each part of the pouch-type container and the pouch package can be varied in design in many ways.

LIST OF REFERENCE CHARACTERS

A1, A11, A2, A21: Pouch-type container
B1, B11, B2, B21: Pouch package
1A, 1B: Main-body sheet
2: Opening/closing part
3: Locking band
5: Spout
6: Packaged substance
11: Lock part
12: Constricted portion
13: Wider portion
15: Oblique edge
17: Fold line
18: Opening
19: Storage space
21: First zip sheet
22: Second zip sheet
31: Fixed portion
39: Insertion space
41: Bottom sealed part
42: Side sealed part
43: First zip-sealed part
44: Second zip-sealed part
51: Body
52: Cap
71: Spout nozzle
72: Discharging pipe
75: Pressurizer
80: Combined indication
81: First indication
82: Second indication
120: Base edge
121: First edge
122: Second edge
170: Folding portion
211, 221: Support part
212, 222: Zip part
W0: Distance
W1, W2: Width

The invention claimed is:

1. A pouch-type container comprising:

a pair of main-body first and second sheets defining a storage space for containing a packaged substance;

an opening at a first end of the main-body first and second sheets in a first direction;

a spout at a second end, opposite the opening, of the main-body first and second sheets in the first direction;

an opening/closing part offset from the opening toward the second end in the first direction and configured to open and close the storage space;

a locking band fixed to both of the main-body first and second sheets at a pair of fixed portions spaced apart from each other in a width direction to define an insertion space with an outer surface of the main-body first and second sheets, the width direction being perpendicular to a direction in which the main-body first and second sheets face each other and the first direction; and a lock part comprising at least one of the main-body first and second sheets and configured to be locked with the locking band by being inserted into the insertion space with the main-body first and second sheets folded back.

2. The pouch-type container according to claim 1, wherein the lock part includes a constricted portion whose minimum dimension in the width direction is smaller than a dimension between the fixed portions in the width direction, and a wider portion offset from the constricted portion toward the first end in the first direction and having a dimension in the width direction larger than the dimension between the fixed portions in the width direction.

3. The pouch-type container according to claim 2, wherein the opening/closing part and the constricted portion overlap with each other in the first direction.

4. The pouch-type container according to claim 2, wherein the constricted portion has a base edge positioned inward in the width direction, a first edge offset from the base edge toward the first end in the first direction, and a second edge offset from the base edge toward the second end in the first direction, the first edge has an inclination angle with respect to the first direction that is larger than an inclination angle of the second edge with respect to the first direction.

5. The pouch-type container according to claim 1, wherein the fixed portions are provided on opposite sides of the storage space in the width direction.

6. The pouch-type container according to claim 1, wherein the opening/closing part is made of a first zip sheet and a second zip sheet that are joined to inner surfaces of the paired main-body first and second sheets, respectively, each of the first zip sheet and the second zip sheet has a zip part to perform an open/close function, the first zip sheet and the inner surface of one of the main-body first and second sheets are joined only at a region offset from the zip part of the first zip sheet toward the first end in the first direction, and the second zip sheet is joined to the inner surface of another one of the main-body first and second sheets at least at opposite sides of the zip part of the second zip sheet in the first direction.

7. A pouch package comprising:

a pouch-type container according to claim 1, and a packaged substance contained in the storage space.

8. The pouch-type container according to claim 1, wherein the main-body first sheet is formed with notches at the fixed portions, respectively, thereby causing the locking band and the main-body second sheet to be joined together through the notches.

* * * * *